US011446584B2

(12) United States Patent
Yang et al.

(10) Patent No.: US 11,446,584 B2
(45) Date of Patent: Sep. 20, 2022

(54) APPARATUS AND METHOD FOR GENERATING BUBBLES

(71) Applicant: Honor Metro Limited, Kowloon (HK)

(72) Inventors: Nai Yang, Temple City, CA (US); Ami Shapiro, Woodland Hills, CA (US); Jeff Falerni, Agoura Hills, CA (US)

(73) Assignee: HONOR METRO LIMITED, Kowloon (HK)

( * ) Notice: Subject to any disclaimer, the term of this patent is extended or adjusted under 35 U.S.C. 154(b) by 310 days.

(21) Appl. No.: 16/796,559

(22) Filed: Feb. 20, 2020

(65) Prior Publication Data

US 2021/0260496 A1 Aug. 26, 2021

(51) Int. Cl.
*A63H 33/28* (2006.01)

(52) U.S. Cl.
CPC ..... *A63H 33/28* (2013.01)

(58) Field of Classification Search
CPC ..... A63H 33/28
USPC ..... 446/15, 16
See application file for complete search history.

(56) References Cited

U.S. PATENT DOCUMENTS

| | | | |
|---|---|---|---|
| 1,994,859 | A | 3/1935 | Langum |
| D126,997 | S | 5/1941 | Bentzen et al. |
| 2,412,732 | A | 12/1946 | Holman |
| 2,452,794 | A | 11/1948 | Saachy |
| D153,814 | S | 5/1949 | Margolis |
| D154,921 | S | 8/1949 | Haffner |
| D154,922 | S | 8/1949 | Haffner |
| 2,632,281 | A | 3/1953 | Schmidt, Jr. |
| 2,736,988 | A | 3/1956 | Fisher |
| 2,942,375 | A | 6/1960 | Bucic, Jr. |
| 3,401,858 | A | 9/1968 | White |

(Continued)

FOREIGN PATENT DOCUMENTS

| | | |
|---|---|---|
| CA | 2824412 A1 | 8/2012 |
| CN | 2103358 U | 5/1992 |

(Continued)

OTHER PUBLICATIONS

Funrise—Gazillion Bubble Storm, available on Kohls.com, Retrieved Sep. 27, 2021., Available URL: https://www.kohls.com/product/prd-4476930/ (Year: 2019).

(Continued)

*Primary Examiner* — Joseph B Baldori
(74) *Attorney, Agent, or Firm* — Belles Katz LLC

(57) ABSTRACT

An apparatus and method for producing bubbles. The apparatus may include a motor, a fan device operably coupled to the motor to generate an air stream, and a bubble generating assembly operably coupled to the fan device so as to be rotated. The apparatus may also include a bubble solution dispenser for dispensing bubble solution onto bubble generating devices of the bubble generating assembly. Furthermore, a support member may be provided for supporting a container of the bubble solution. The support member may be altered into a dispensing position whereby the bubble solution can be dispensed from the container into the bubble solution dispenser. When the support member is in the dispensing position, a switch that activates the motor may be actuated into a closed state. The support member may include an actuation member that engages the switch when in the dispensing position.

18 Claims, 20 Drawing Sheets

(56) References Cited

U.S. PATENT DOCUMENTS

| | | | | |
|---|---|---|---|---|
| 4,044,496 | A | 8/1977 | Jernstrom | |
| 4,133,138 | A | 7/1979 | Coons | |
| 4,775,348 | A | 10/1988 | Collins | |
| 4,839,014 | A | 6/1989 | Park | |
| 4,840,143 | A | 6/1989 | Simon | |
| D334,251 | S | 3/1993 | Tiu | |
| D353,166 | S | 12/1994 | Kwak | |
| D371,643 | S | 7/1996 | Lillelund et al. | |
| D374,480 | S | 10/1996 | Micoley | |
| 5,832,969 | A | 11/1998 | Schramm | |
| D419,204 | S | 1/2000 | Bao | |
| 6,102,764 | A | 8/2000 | Thai | |
| 6,200,184 | B1 | 3/2001 | Rich et al. | |
| 6,328,286 | B1 | 12/2001 | Sanchez et al. | |
| 6,331,130 | B1 | 12/2001 | Thai | |
| 6,450,851 | B1 * | 9/2002 | Rehkemper | A63H 33/28 446/15 |
| D490,861 | S | 6/2004 | Buzzelli | |
| 6,820,662 | B2 * | 11/2004 | Crawford | A63H 33/28 141/366 |
| 7,021,986 | B2 | 4/2006 | Thai | |
| 7,144,291 | B2 | 12/2006 | Thai | |
| 7,172,484 | B2 | 2/2007 | Thai | |
| D577,808 | S | 9/2008 | Chang | |
| D608,437 | S | 1/2010 | Wawoe | |
| 7,780,497 | B2 | 8/2010 | Thai | |
| D637,362 | S | 5/2011 | Gunn | |
| D642,629 | S | 8/2011 | Lo | |
| D643,477 | S | 8/2011 | Lo | |
| 8,123,584 | B2 | 2/2012 | Thai | |
| 8,272,915 | B2 | 9/2012 | Thai | |
| 8,272,916 | B2 | 9/2012 | Thai | |
| 8,555,814 | B2 | 10/2013 | Parks et al. | |
| 8,985,054 | B2 | 3/2015 | Lipscomb | |
| D750,939 | S | 3/2016 | Kellow, Jr. | |
| 9,339,737 | B2 | 5/2016 | Chan | |
| D781,659 | S | 3/2017 | Kellow, Jr. | |
| D785,393 | S | 5/2017 | Palermo et al. | |
| D790,009 | S | 6/2017 | Lo et al. | |
| 9,878,262 | B2 | 1/2018 | Chan | |
| D827,213 | S | 8/2018 | Veness | |
| 10,363,492 | B1 * | 7/2019 | Thai | A63H 33/28 |
| D858,901 | S | 9/2019 | Zhong | |
| 10,702,787 | B2 * | 7/2020 | Thai | A63H 33/28 |
| 10,702,788 | B2 | 7/2020 | Thai | |
| D893,634 | S | 8/2020 | Zhang | |
| D896,894 | S | 9/2020 | Yang | |
| D903,080 | S | 11/2020 | Morton | |
| D924,982 | S | 7/2021 | Yang | |
| 2002/0115372 | A1 | 8/2002 | Thai | |
| 2003/0116224 | A1 | 6/2003 | Crawford | |
| 2004/0094228 | A1 | 5/2004 | Nadel et al. | |
| 2009/0163109 | A1 | 6/2009 | Thai | |
| 2009/0209163 | A1 | 8/2009 | Thai | |
| 2010/0173558 | A1 | 7/2010 | Huey | |
| 2011/0081821 | A1 | 4/2011 | Temiz | |
| 2012/0214378 | A1 | 8/2012 | Lo | |
| 2012/0220184 | A1 | 8/2012 | Orem | |
| 2014/0027528 | A1 | 1/2014 | Attey | |
| 2014/0326723 | A1 | 11/2014 | Scharfe | |
| 2015/0130089 | A1 | 5/2015 | Westphal | |
| 2015/0133021 | A1 | 5/2015 | Huey | |
| 2015/0265940 | A1 * | 9/2015 | Chan | A63H 33/28 446/16 |
| 2018/0221784 | A1 | 8/2018 | Huey | |
| 2018/0272245 | A1 | 9/2018 | Pogue | |
| 2020/0061487 | A1 | 2/2020 | Thai | |
| 2020/0139262 | A1 | 5/2020 | Yang | |
| 2020/0155957 | A1 | 5/2020 | Clayton | |
| 2021/0129040 | A1 | 5/2021 | Chan | |
| 2021/0260496 | A1 | 8/2021 | Yang | |

FOREIGN PATENT DOCUMENTS

| | | | |
|---|---|---|---|
| CN | 2907803 | Y | 6/2007 |
| CN | 2907813 | Y | 6/2007 |
| CN | 2930817 | Y | 8/2007 |
| CN | 201055703 | Y | 5/2008 |
| CN | 20167639 | Y | 6/2008 |
| CN | 202427173 | U | 9/2012 |
| CN | 306522852 | | 5/2021 |
| CN | 306762167 | | 8/2021 |
| EP | 2921213 | A1 | 9/2015 |
| WO | WO 2004/012831 | A2 | 2/2004 |
| WO | WO2017001711 | | 1/2017 |

OTHER PUBLICATIONS

Gazillion 36540, available on Amazon.com. Retrieved on Sep. 27, 2020., Available URL: https://www.amazon.co.uk/Gazillion-36450-Bubble-Storm/dp/B0844PQ6ZZ/ (Year: 2020).

Gazillion Bubble Storm, available on Amazon.com, Retrieved Sep. 27, 2021., Available URL: https://www.amazon.com/Gazillion-Bubble-Storm-Making-Machine/dp/B0844PQ6ZZ/ (Year: 2020).

International Search Report and Written Opinion for International Application No. PCT/US21/17045 dated Jun. 24, 2021.

Gazillion Tornado, available on Amazon.co.uk, date first available Mar. 13, 2015. Retreived Mar. 2, 2022. Available URL: https://www.amazon.co.uk/Gazillion-Bubbles-Tornado-Bubble-Toy/dp/B00QCHRE2C/ (Year: 2015).

UCORN Rocket Bubble Machine, available on Amazon.com. Retreived Mar. 2, 2022. Available URL: https://www.amazon.com/dp/B09333F96D/ (Year: 2020).

* cited by examiner

APPARATUS AND METHOD FOR GENERATING BUBBLES

BACKGROUND OF THE INVENTION

Children love bubbles and the bubble makers that are used to create them. At least as far as children are concerned, there is a general understanding that the more bubbles that are made and the quicker they are made, the better the bubble maker. Simple wands that produce bubbles by loading the wands with a bubble solution and blowing through the wands with air from a person's mouth are well known. Furthermore, certain types of automated bubble producing devices, such as bubble producing guns, are also known. However, these types of devices can make a terrible mess in the hands of a child (the same goes for some adults, too). For purposes of generating more bubbles, and making less of a mess, stand-alone bubble generating toys have been designed. Such a toy generates bubbles by forming a film of bubble solution using an applicator as air streams through bubble-forming openings. This type of bubble generating toy requires bubble solution to be pumped from a reservoir at the base of the assembly and streamed over the bubble-forming openings. Furthermore, excess bubble solution must be collected so that it can be directed back into the reservoir. Toys of this type also blow air through small air tubes, which direct the air to the bubble-forming openings to help form the bubbles. Existing automated bubble making devices are messy, difficult and expensive to manufacture, and difficult to use. Thus, a need exists for an apparatus for generating bubbles which overcomes the above-noted deficiencies.

BRIEF SUMMARY OF THE INVENTION

Exemplary embodiments according to the present disclosure are directed to an apparatus for generating bubbles and to a method of generating bubbles. The apparatus may include a motor, a fan device operably coupled to the motor to generate an air stream, and a bubble generating assembly operably coupled to the fan device so as to be rotated. The apparatus may also include a bubble solution dispenser for dispensing bubble solution onto bubble generating devices of the bubble generating assembly. Furthermore, a support member may be provided for supporting a container of the bubble solution. The support member may be altered into a dispensing position whereby the bubble solution can be dispensed from the container into the bubble solution dispenser. When the support member is in the dispensing position, a switch that activates the motor may be actuated into a closed state. The support member may include an actuation member that engages the switch when in the dispensing position.

In one aspect, the invention may be an apparatus for generating bubbles comprising: a housing extending along a longitudinal axis; a motor positioned in the housing; a fan device operably coupled to the motor to generate an air stream; a bubble generating assembly comprising at least one bubble generating device that is aligned with the air stream generated by the fan device; a bubble solution dispenser comprising at least one delivery member for delivering bubble solution to the at least one bubble generating device; a support member configured to support a bubble solution container containing a bubble solution, the support member alterable between a non-dispensing position wherein the bubble solution does not flow out of the bubble solution container and a dispensing position wherein the bubble solution flows out of the bubble solution container and into the bubble solution dispenser; and wherein altering the support member from the non-dispensing position to the dispensing position while the support member supports the bubble solution container actuates a switch to power the motor.

In another aspect, the invention may be an apparatus for generating bubbles comprising: a power source; a motor; a switch alterable between an open state in which the power source is not operably coupled to the motor and a closed state in which the power source is operably coupled to the motor to cause the motor to rotate about a rotational axis; a fan device operably coupled to the motor so that the fan device generates an air stream when the switch is in the closed state; a bubble generating assembly comprising at least one bubble generating device that is aligned with the air stream generated by the fan device; a bubble solution dispenser comprising at least one delivery member for loading a bubble solution onto the at least one bubble generating device; a support member supporting a container of bubble solution, the support member alterable between a non-dispensing position in which the container is prevented from dispensing the bubble solution into the bubble solution dispenser and a dispensing position in which the container dispenses the bubble solution into the bubble solution dispenser; and wherein when the support member is in the dispensing position the switch is actuated into the closed state.

In yet another aspect, the invention may be an apparatus for generating bubbles comprising: a power source; a motor; a switch alterable between an open state in which the power source is not operably coupled to the motor and the motor is static and a closed state in which the power source is operably coupled to the motor and the motor rotates about a rotational axis; a fan device operably coupled to the motor so that the fan device generates an air stream when the switch is in the closed state; a bubble generating assembly comprising at least one bubble generating device that is aligned with the air stream generated by the fan device, the bubble generating assembly coupled to the motor so that the bubble generating device rotates about the rotational axis when the switch is in the closed state; a bubble solution dispenser comprising at least one delivery member for loading a bubble solution onto the at least one bubble generating device; a support member adjustable between a non-dispensing position in which the support member supports a container of bubble solution at an orientation such that the container cannot dispense the bubble solution into the bubble solution dispenser and a dispensing position in which the support member supports the container at an orientation such that the container dispenses the bubble solution into the bubble solution dispenser; and wherein when the support member supports the container of bubble solution in the dispensing position, the switch is automatically altered into the closed state.

In a further aspect, the invention may be an apparatus for generating bubbles comprising: a power source; a motor; a switch alterable between an open state in which the power source is not operably coupled to the motor and the motor is static and a closed state in which the power source is operably coupled to the motor and the motor rotates about a rotational axis; a fan device operably coupled to the motor so that the fan device generates an air stream when the switch is in the closed state; a bubble generating assembly comprising at least one bubble generating device that is aligned with the air stream generated by the fan device, the bubble generating assembly coupled to the motor so that the bubble generating device rotates about the rotational axis when the switch is in the closed state; a bubble solution dispenser comprising at least one delivery member for loading a bubble solution onto the at least one bubble generating device, the bubble solution dispenser configured to hold a container of bubble solution in an upside-down orientation so that the bubble solution in the container is dispensed into the bubble solution dispenser; and wherein when the bubble solution dispenser is holding the container of bubble solution in the upside-down orientation, the switch is automatically actuated into the closed state.

In a still further aspect, the invention may be an apparatus for generating bubbles comprising: a housing extending along a longitudinal axis, the housing comprising: an outer annular wall; a first inner annular wall spaced radially inward of the outer annular wall so that an excess fluid passageway is defined between the outer annular wall and the first inner annular wall, the first inner annular wall connected to the outer annular wall to form a floor of the excess fluid passageway, the floor having at least one opening; and a second inner annular wall spaced radially inward of the first inner annular wall so that an air flow passageway is defined between the first and second inner annular walls; a motor positioned in the housing; a fan device operably coupled to the motor to generate an air stream that flows through the air flow passageway; a bubble generating assembly comprising at least one bubble generating device that is aligned with the air stream generated by the fan device; a bubble solution dispenser comprising at least one delivery member for loading a bubble solution onto the at least one bubble generating device; and wherein excess amounts of the bubble solution that are dispensed from the bubble solution dispenser without being loaded onto the at least one bubble generating device flows into the excess fluid passageway, through the opening in the floor of the excess fluid passageway, and into a collection trough.

In another aspect, the invention may be a method of generating bubbles comprising: supporting a container of bubble solution with a support member; pivoting the support member relative to a housing to position the container in an upside-down orientation so that the bubble solution flows out of the container and into a bubble solution delivery member, the support member activating a switch to cause a bubble generating assembly to rotate about a rotational axis; dispensing the bubble solution from the bubble solution delivery member onto one or more bubble generating devices of the bubble generating assembly as the bubble generating assembly rotates about the rotational axis; and generating an air stream with an air stream generator and flowing the air stream through the one or more bubble generating devices of the bubble generating assembly to produce bubbles from the bubble solution that has been loaded on the one or more bubble generating devices.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
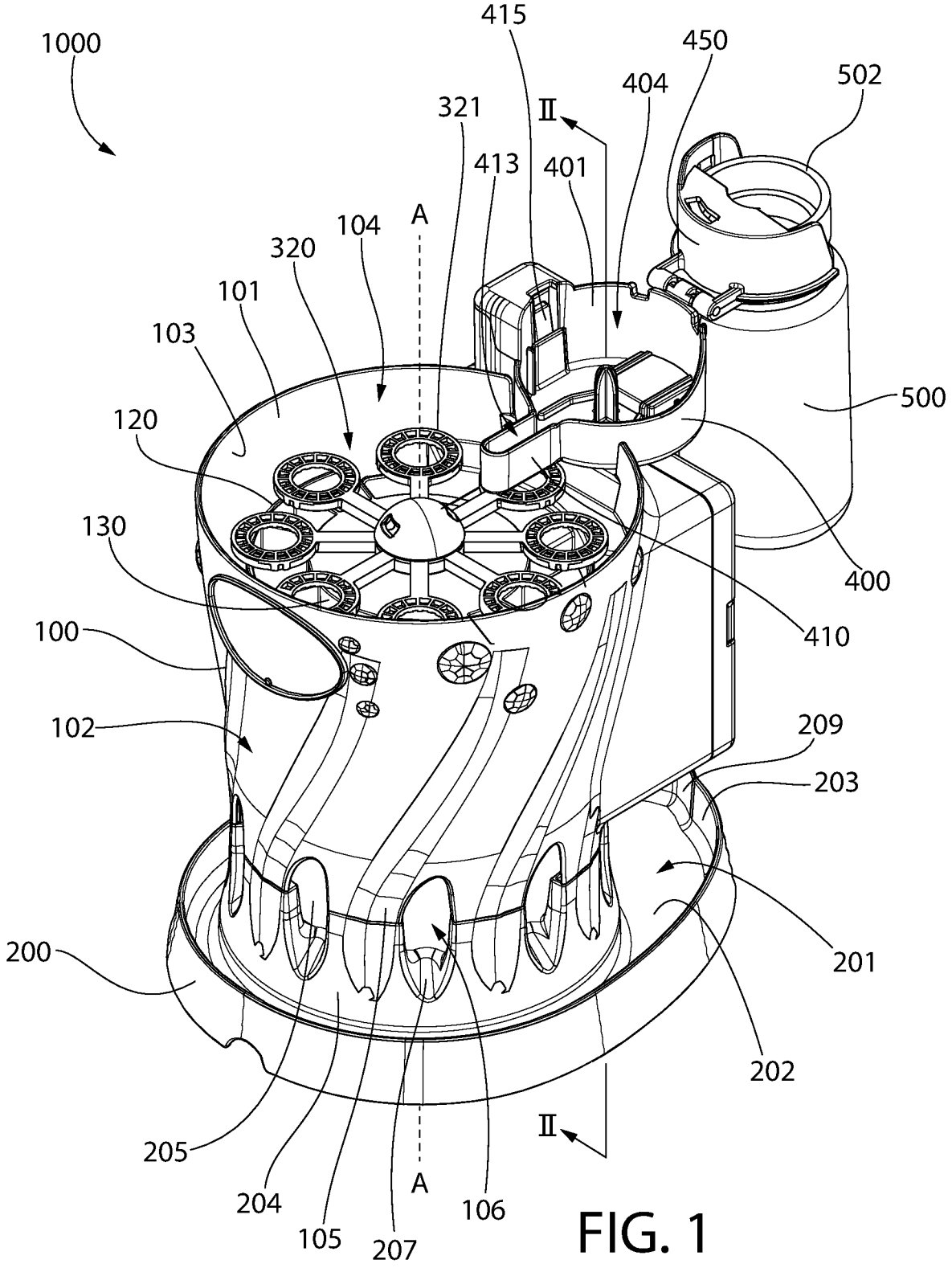
FIG. 1 is a front perspective view of an apparatus for generating bubbles in accordance with an embodiment of the present invention, wherein a support member is supporting a container of bubble solution in a non-dispensing position

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIGS. 1-4, an apparatus for generating bubbles 1000 (hereinafter referred to as the apparatus 1000) will be described. The apparatus 1000 may also be referred to herein as a bubble generating machine. The apparatus 1000 is designed to generate bubbles from a bubble solution in an automatic fashion by way of moving parts that are operably coupled to a motor. Thus, a bubble solution may be dispensed onto bubble generating devices and then bubbles can be generated from the bubble solution loaded on the bubble generating devices as an air stream flows through the bubble generating devices. In some embodiments, there are no pumps, valves, or other similar types of devices included for facilitating movement of the bubble solution to the bubble generating devices. Thus, the apparatus 1000 may be devoid of any pumps in some embodiments. Furthermore, in some embodiments a user need not actuate a switch or the like to power on the apparatus 1000. Rather, in some embodiments when a container of bubble solution is held by the apparatus 1000 in an upside down orientation so that the bubble solution is dispensed from the container into the apparatus 1000, the apparatus 1000 is automatically powered on. The details of this functionality will be described in greater detail below.

The apparatus 1000 comprises a housing 100 extending along a longitudinal axis A-A and a drip tray 200 that is detachably coupled to the housing 100. As will be discussed in greater detail below, excess amounts of the bubble solution that are dispensed from the apparatus 1000 but not loaded onto a bubble generating device will be collected in a collection trough 201 of the drip tray 200. The excess bubble solution that is collected in the collection trough 201 can later be poured back into a container for reuse. By having the housing 100 detachable from the drip tray 200, the drip tray 200 can be easily lifted up and tilted to pour the collected excess bubble solution back into a container.

The drip tray 200 comprises a floor 202, an outer wall 203 protruding from the floor 202 along an outer edge of the floor 202, and a drainage member 204 protruding from the floor 202 in a spaced apart manner from the outer wall 203 so that the outer wall 203 surrounds the drainage member 204. The space between the inner surface of the outer wall 203 and the outer surface of the drainage member 204 forms the collection trough 201. The collection trough 201 has an open top end so that any bubble solution or other fluid collected therein can be readily seen by a user. In this way, a user will readily know when the collection trough 201 is becoming full so that the user can shut down the apparatus 1000 to pour the bubble solution from the collection trough 201 back into a container.

The drainage member 204 extends from the floor 202 to a distal surface 205. In the exemplified embodiment, the drainage member 204 is not centered along the floor 202 of the drip tray 200. Rather, the drainage member 204 is offset from a centerpoint of the floor 202 of the drip tray 200. As a result, the housing 100 does not block visual access to the collection trough 201. Rather, a user could look down onto the apparatus 1000 from above and some of the collection trough 201 would be visible. Thus, a line of sight exists from a top of the apparatus 1000 to the collection trough 201 from a top plan view. Stated another way, the drip tray 200 and the housing 100 have different footprints which permits ready user visualization of any fluids collected in the collection trough. The drip tray 200 comprises a pour spout 209 along the outer wall 203 to allow for easy pouring of the bubble solution collected in the collection trough 201 back into a container or the like.

Furthermore, the drainage member 204 comprises a plurality of connection members 206 extending from the distal surface 205 in a spaced apart manner. In the exemplified embodiment, the connection members 206 are arranged circumferentially around the outer surface of the drainage member 204 and protrude upwardly away from the distal surface 205. Furthermore, in the exemplified embodiment each of the connection members 206 defines a receiving cavity for receiving a component of the housing 100 to couple the housing 100 to the drip tray 200, as described in greater detail below.

In the exemplified embodiment, the drainage member 204 has a plurality of inclined drainage surface 207 in the space between each pair of adjacent connection members 206. Specifically, the outer surface of the drainage member 204 is sloped between the adjacent connection members 206 to facilitate the flow of any excess amounts of the bubble solution down the inclined drainage surfaces 207 and into the collection trough 201. The inclined drainage surfaces 207 are inclined in a downward direction from the distal surface 205 of the drainage member 204 towards the collection trough 201.

The housing 100 comprises an outer annular wall 101 having an outer surface 102 that forms an exposed outer surface of the housing 100 and an inner surface 103 that surrounds or defines an internal cavity 104 of the housing 100. A lower portion of the outer annular wall 101 terminates in a plurality of circumferentially spaced apart connection members 105 that are configured to engage or otherwise interact with the connection members 206 of the drip tray 200 to couple the housing 100 to the drip tray 200. In the exemplified embodiment, the connection members 105 are protuberances that are received within the receiving cavities of the connection members 206 of the drip tray 200. Of course, in alternative embodiments an opposite arrangement could be used whereby the connection members 206 of the drip tray 200 are received within cavities of the connection members 105 of the housing 100. Moreover, other structures and modifications could be used in other embodiment so long as it facilitates a detachable coupling between the housing 100 and the drip tray 200.

In the exemplified embodiment, the coupling of the connection members 105 of the housing 100 to the connection members 206 of the drip tray 200 creates an interference fit or a frictional fit to couple the housing 100 to the drip tray 200. The interference fit should be sufficiently snug and tight so that a user can lift the apparatus 1000 by gripping only the housing 100 such that the drip tray 200 remains coupled to the housing 100. In other embodiments, fasteners such as screws, bolts, or the like could be used to facilitate the coupling of the housing 100 to the drip tray 200. However, the friction fit may be desirable in some embodiments because it allows for an easy detachment of the housing 100 from the drip tray 200 for cleaning and to pour any bubble solution collected in the collection trough 201 back into a container or bottle for storage or re-use. In other embodiments, the connection members may be located along the longitudinal axis A-A rather than circumferentially surrounding the longitudinal axis A-A as with the exemplified embodiment. Various permutations and modifications to the connection members 105, 206 may be possible in alternative embodiments.

When the housing 100 is coupled to the drip tray 200 in the manner described herein, a plurality of air inlet openings 106 are formed in the spaces between the connection members 105, 206. The air inlet openings 106 allow for ambient air to be pulled into the internal cavity 104 of the housing 100 for purposes of generating an air stream that can be used to generate bubbles from the bubble solution loaded on the bubble generating devices. In the exemplified embodiment, each of the air inlet openings 106 is a closed-geometry shaped opening (more specifically, oval in the exemplified embodiment although any other shape could be formed) that is bounded by an edge of two adjacent ones of the connection members 105 of the housing 100 and an edge of two adjacent ones of the connection members 206 of the drip tray 200. Thus, the edges of the connection members 105, 206 define the air inlet openings 106. The inclined drainage surfaces 207 are located along or adjacent to a bottom of each of the air inlet openings 106 such that the excess fluid can flow through the air inlet openings 106 and down along the inclined drainage surfaces 207 to the collection trough 201 of the drip tray 200.

The apparatus 1000 further comprises a motor 300 positioned in the internal cavity 104 of the housing 100, a fan device 310 operably coupled to the motor 300 so that the motor can rotate the fan device 310 to generate an air stream, a bubble generating assembly 320 comprising at least one, and more specifically a plurality of bubble generating devices 321, a bubble solution dispenser 400 that dispenses the bubble solution onto the bubble generating devices 321, and a support member 450 for supporting a container 500 containing a store of bubble solution 501 therein. In the exemplified embodiment, the apparatus 1000 also comprises a power source 550, which in the exemplified embodiment comprises a plurality of batteries. In other embodiments, the apparatus 1000 may include a power cord that is configured to be plugged into a wall socket to supply power to the electronic devices of the apparatus 1000. Furthermore, other types of power sources can be used and the invention is not limited to batteries and AC power from a socket as noted herein. In the exemplified embodiment, the apparatus also comprises a screen member 600 positioned to prevent a user from placing fingers or the like into contact with the fan device 310 particularly while it is operating and spinning at high speeds. In the exemplified embodiment, the screen member 600 is positioned between the fan device 310 and the dip tray 200 so that even if a user is able to extend his/her fingers through the air inlet openings 106, the user will not be able to contact the fan device 310.

The fan device 310 comprises a hub portion 311 and a plurality of blades 312 extending outwardly from the hub portion 311 to generate an air stream when the fan device 310 is rotated. In the exemplified embodiment, the fan device 310 comprises three of the blades 312, although more or less blades could be used in other embodiments. Moreover, it should be appreciated that the fan device 310 is not limited to being a fan in all embodiments, but can be any device that is configured to generate an air stream when it is powered on. Thus, the fan device 310 may be any type of air generator, air flow generator, air stream generator, or the like. In the exemplified embodiment, the fan device 310 is coupled to a first shaft 301 of the motor 300. In the exemplified embodiment, the fan device 310 is coupled directly to the motor 300 with no intervening gears or the like. Thus, the fan device 310 will rotate at the same rotational speed (rotations per minute) as the motor 300. This ensures that a sufficiently viable air stream is generated by the fan device 310 to ensure that it is capable of generating bubbles from the bubble solution 501 loaded onto the bubble generating devices 321 of the bubble generating assembly 320. Of course, in other embodiments gears may be coupled to the fan device 310 and the motor 300 to either speed up or slow down the rotational speed (e.g., revolutions per minute) of the fan device 310 as compared to the rotational speed of the motor 300.

The bubble generating assembly 320 comprises a plurality of the bubble generating devices 321 as noted above. Specifically, in the exemplified embodiment the bubble generating assembly 320 comprises a hub portion 322, a plurality of arms 323 extending radially from the hub portion 322 in a spaced apart manner, and the plurality of bubble generating devices 321 each coupled to an end of one of the arms 323. In the exemplified embodiment, each of the bubble generating devices 321 is an annular-shaped structure having an inner surface 324 that surrounds a central aperture 325. Furthermore, the bubble generating devices 321 comprise a plurality of ribs or ridges 326 protruding from the inner surface 324 in a spaced apart manner. The ridges 326 assist in loading bubble solution onto the bubble generating devices 321. Specifically, when a bubble solution is dripped onto the bubble generating devices 321 or the bubble generating devices 321 are dipped into a reservoir of bubble solution, the bubble solution adheres to the bubble generating devices 321 along the ridges 326 on the inner surface 324. The bubble solution will then extend across the central aperture 325, thereby forming a film of the bubble solution that fills in the space defined by the inner surface 324 of the bubble generating devices 321. When the bubble solution adheres to the bubble generating devices 321, those bubble generating devices 321 are considered to be loaded with the bubble solution.

In the exemplified embodiment, the bubble generating assembly 320 is operably coupled to a second shaft 302 of the motor 300. Thus, in the exemplified embodiment the bubble generating assembly 320 rotates about a rotational axis during use of the apparatus 1000. However, in other embodiments the bubble generating assembly 320 may be static/fixed rather than rotating and other features may rotate (specifically, the bubble solution dispenser 400) to ensure that the bubble generating devices 321 become loaded with the bubble solution. Turning back to the exemplified embodiment, the bubble generating assembly 321 is indirectly coupled to the motor 300 by a gear assembly 330. The gear assembly 330 is designed to slow down the rotational speed of the bubble generating assembly 320 relative to the motor 300 so that the bubble generating assembly 320 rotates at a slower rotational speed than the motor 300. Thus, the gear assembly 330 operates as a speed reducer such that the output gear (the gear furthest from the motor 302) rotates more slowly than the input gear (the gear closest to the motor 300). The exact configuration and arrangement of the gear assembly 330 including the number and size of the gears thereof, is not to be limiting of the invention in all embodiments.

It should be appreciated that in the exemplified embodiment the motor 300 controls the movement/rotation of both the fan device 310 and the bubble generating assembly 320. In other embodiments, there may be separate motors for controlling rotation of the fan device 310 and the bubble generating assembly 320. In still other embodiments, the motor 300 may control rotation of the fan device 310 but the bubble generating assembly 320 may not rotate. Thus, various modifications to the exemplary embodiment exist and may fall within the scope of the claimed invention. In the exemplified embodiment, it should be appreciated that the rotational axis of the bubble generating assembly 320, the rotational axis of the motor 300, and the rotational axis of the fan device 310 are all the same as one another as the same as the longitudinal axis A-A of the housing 100.

Figure 5:
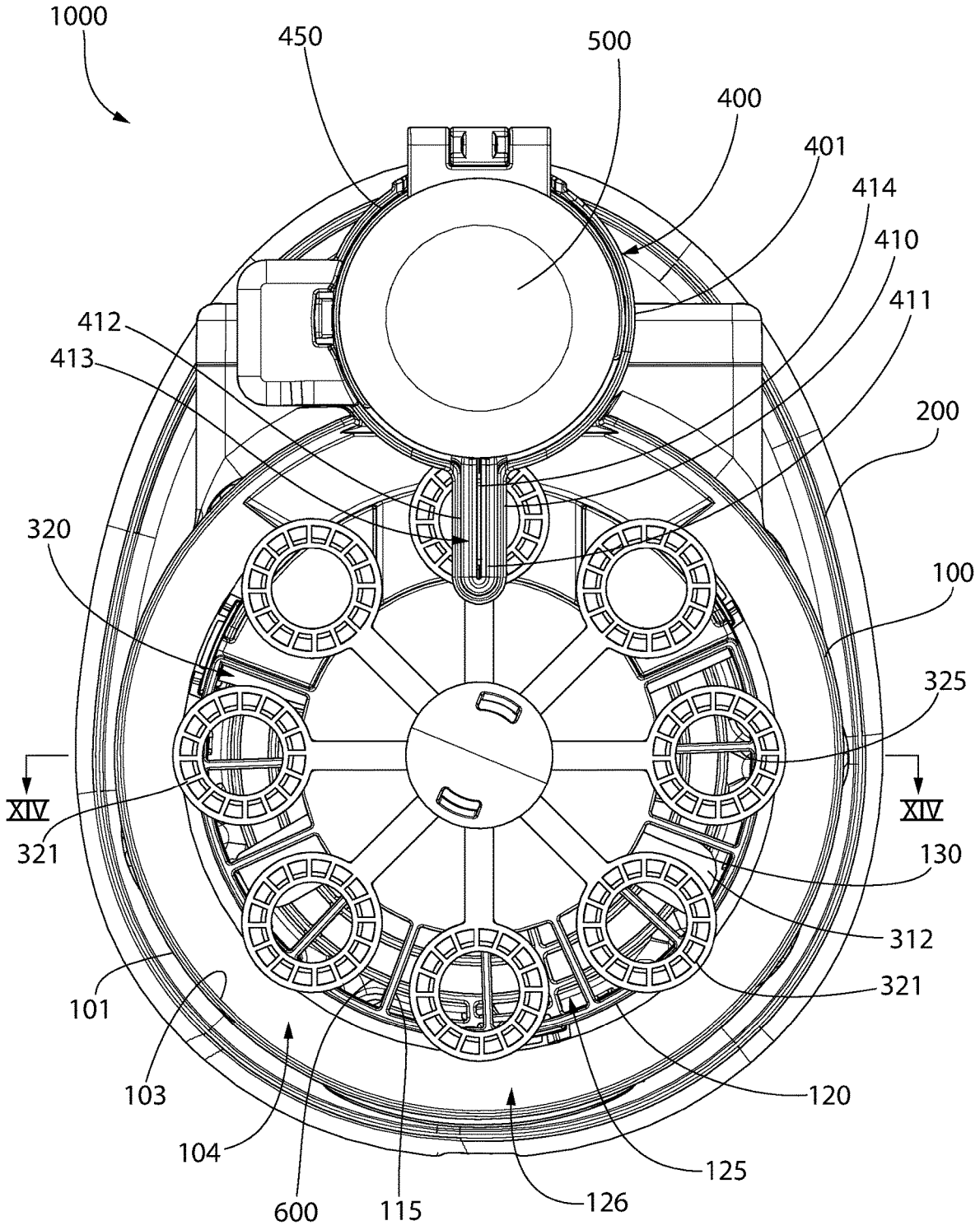
FIG. 5 is a top view of the apparatus of FIG. 1.

Referring to FIGS. 1-3 and 5, the bubble solution dispenser 400 and the support member 450 will be further described. The bubble solution dispenser 400 comprises a main body portion 401 and at least one delivery member 410. In the exemplified embodiment, the main body portion 401 comprises a floor 402 and a sidewall 403 extending upwardly from the floor 402 so that the floor 402 and the sidewall 403 collectively define a holding reservoir 404. The holding reservoir 404 is generally sized and shaped so as to be able to hold a container of bubble solution therein in an upside-down orientation so that the bubble solution contained in the container can be poured into the holding reservoir 404. FIG. 5 illustrates the container 500 of bubble solution positioned in the holding reservoir 404 in the upside-down orientation.

The at least one delivery member 410 extends from the main body portion 401 and into or at least into alignment with the interior cavity 104 of the housing 100. Thus, the at least one delivery member 410 is suspended or cantilevered over the bubble generating devices 321 of the bubble generating assembly 320. Thus, as the bubble generating assembly 320 rotates, the bubble generating devices 321 thereof become aligned with the delivery member 410 one at a time so that they can become loaded with the bubble solution as described herein. The at least one delivery member 410 comprises a floor 411 and a sidewall 412 extending upwardly from the floor 411 so that the floor 411 and the sidewall 412 collectively define a delivery reservoir 413. The at least one delivery member 410 comprises at least one slit 414 (or opening) therein so that bubble solution can fall through the slit for delivery onto the bubble generating devices 321.

The delivery reservoir 413 is in fluid communication with the holding reservoir 404 so that fluid (such as the bubble solution) in the holding reservoir 404 will flow to the delivery reservoir 413 where it is eventually dispensed or delivered through the slit 414 and onto the bubble generating devices 321 of the bubble generating assembly 320 as noted above. As described in greater detail below, as the bubble generating assembly 320 is rotated by the motor 300, the bubble generating devices 321 become aligned with and positioned just beneath the delivery member 410 of the bubble solution dispenser 400. Furthermore, the bubble solution continuously falls through the slit 414 so that the at least one delivery member 410 drops the bubble solution onto the bubble generating devices 321 as they rotate past the delivery member 410 to load the bubble generating devices 321 with the bubble solution. As the bubble generating assembly 320 continues to be rotated by the motor 300, the bubble generating devices 321 become aligned with the air stream generated by the fan device 310 so that the bubble solution loaded onto the bubble generating devices 321 is converted into bubbles.

Figure 2:
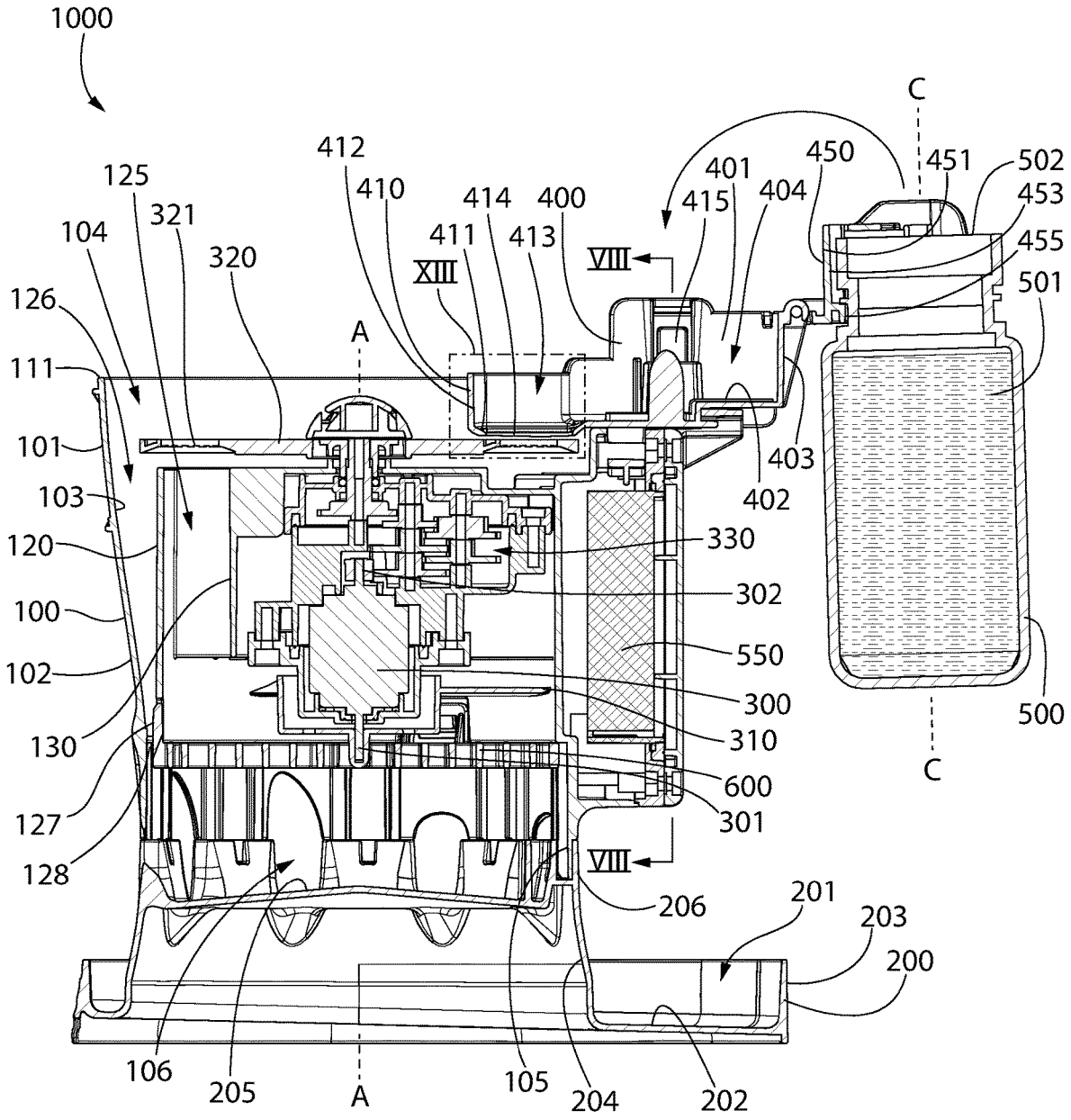
FIG. 2 is a cross-sectional view taken along line II-II of FIG. 1.
Figure 3:
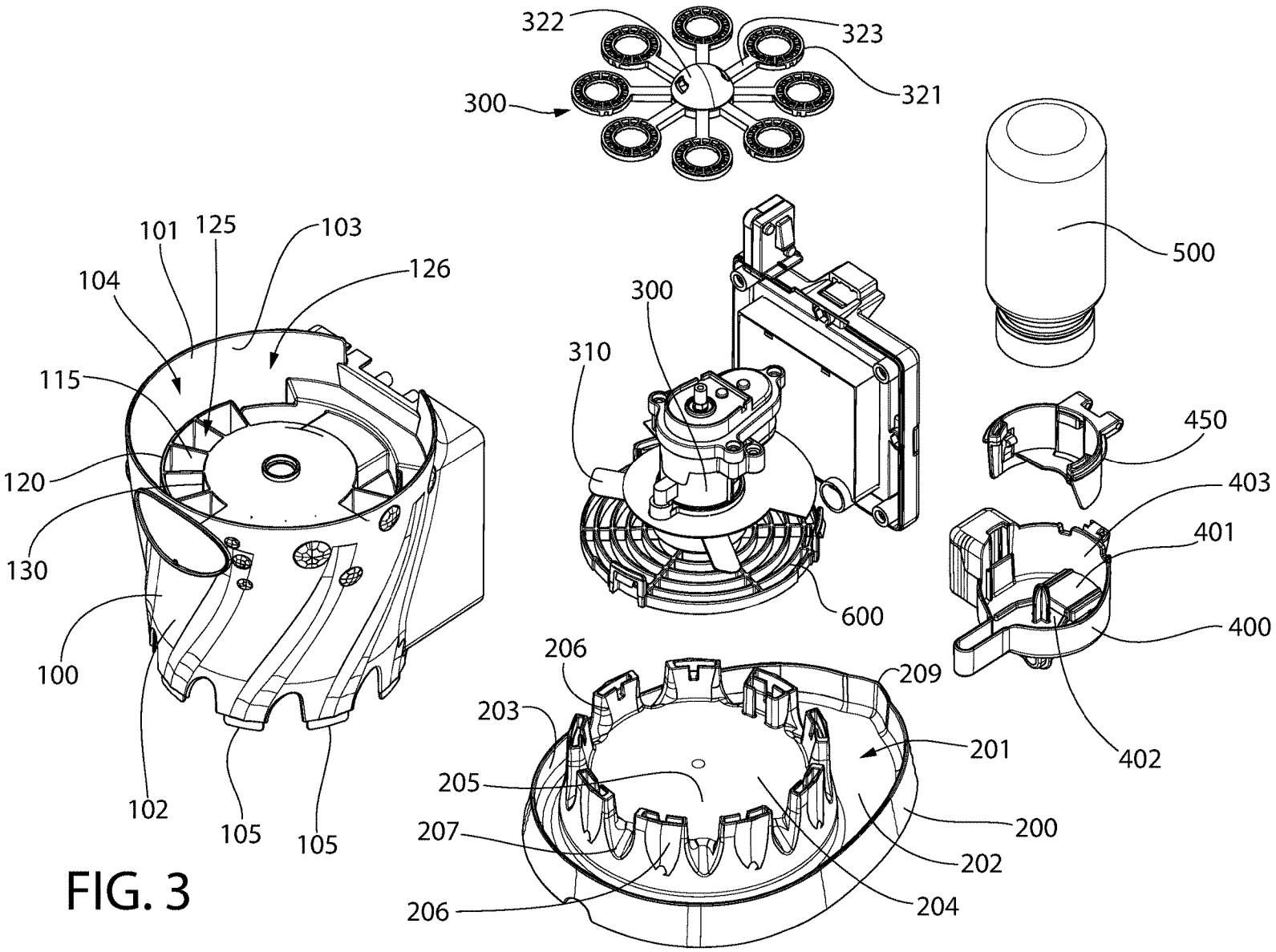
FIG. 3 is an exploded view of the apparatus of FIG. 1.
Figure 4:
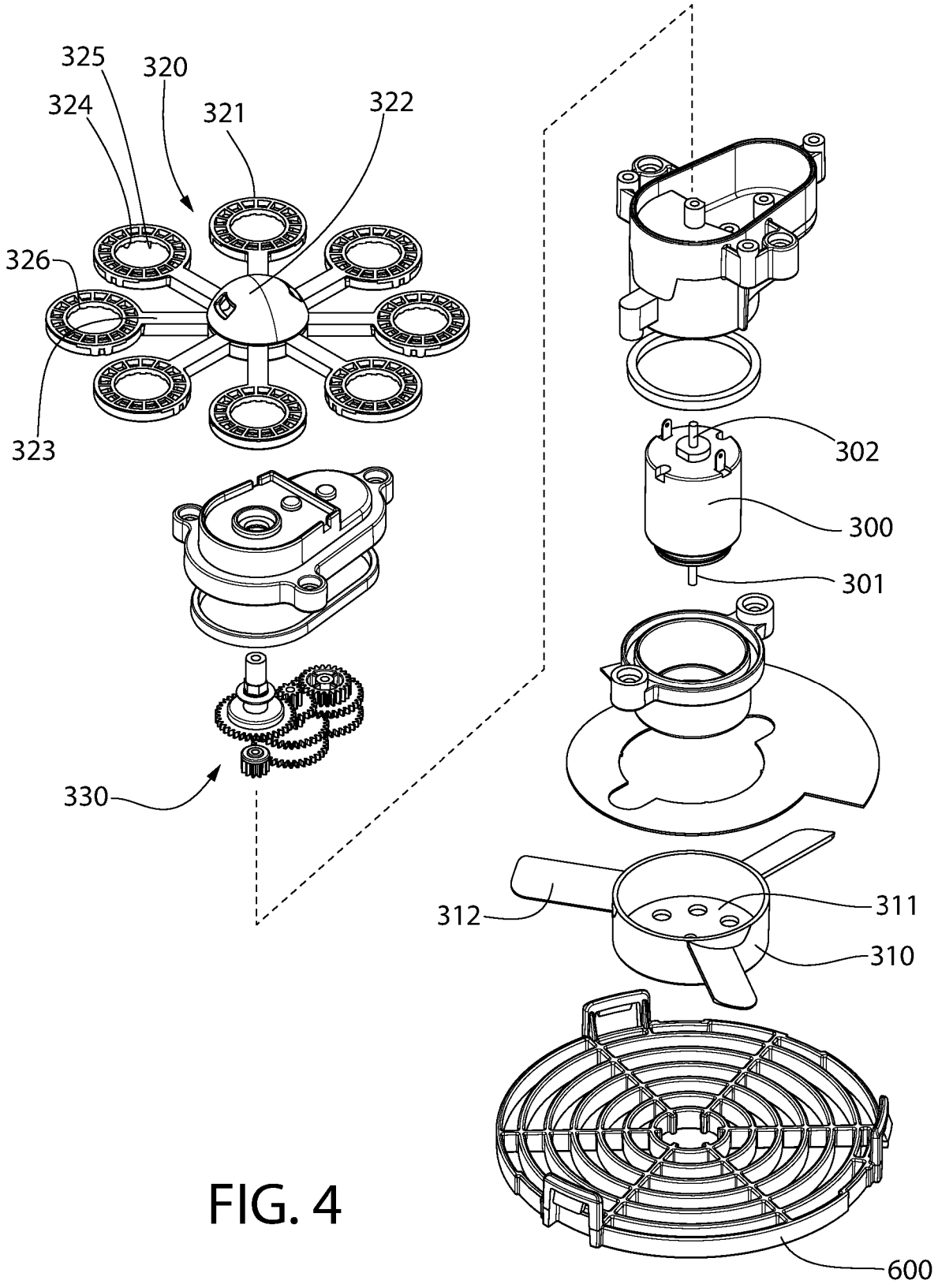
FIG. 4 is an exploded view of a portion of the apparatus of FIG. 1.

Referring to FIGS. 1, 2, and 5, additional structural details of the housing 100 will be provided. The housing 100 comprises the outer annular wall 101 as previously noted, with the inner surface 103 of the outer annular wall 101 defining the interior cavity 104. In the exemplified embodiment, the motor 300, the fan device 310, the bubble generating device 320, and the gear assembly 330 are all positioned within the interior cavity 104 of the housing 100. However, in other embodiments one or more of these components may be located external of the interior cavity 104 of the housing 100. The power source 550 may be positioned within the housing 100 or external to it in various different embodiments.

Figure 6A:
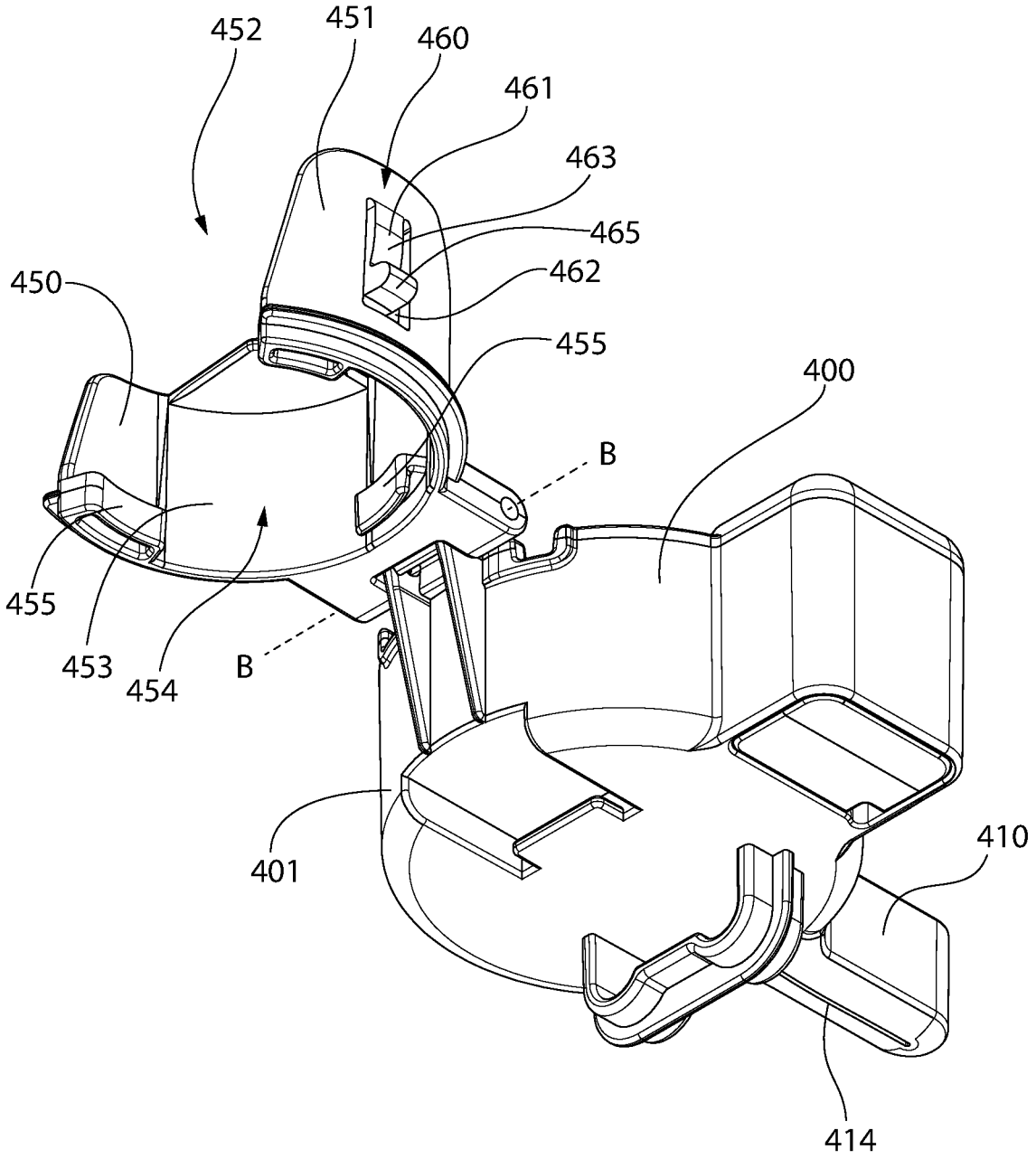
FIGS. 6A and 6B are top and bottom perspective views of a bubble solution dispenser and support member of the apparatus of FIG. 1, wherein the support member is in a non-dispensing position in FIG. 6A and a dispensing position in FIG. 6B.

The housing 100 also comprises a first inner annular wall 120 that is spaced radially inward of the outer annular wall 101 and a second inner annular wall 130 that is spaced radially inward of the first inner annular wall 120. The first and second inner annular walls 120, 130 are connected to one another by a plurality of circumferentially spaced apart fins 115 for structural rigidity and for managing airflow and reducing turbulence with regard to the air stream generated by the fan device 310. The space between the first and second inner annular walls 120, 130 forms an air flow passageway 125 through which the air stream generated by the fan device 310 flows. The air flow passageway 125 is essentially the only opening that leads from the fan device 310 upward so substantially all (i.e., 95% or more) of the air stream generated by the fan device 310 is forced through the air flow passageway 125. The air flow passageway 125 is an annular passageway that surrounds the longitudinal axis A-A of the housing 100. However, in the exemplified embodiment the air flow passageway 125 does not extend a full 360° around the longitudinal axis A-A. Rather, the air flow passageway 125 extends approximately between 180° and 300°, more specifically between 180° and 280°, more specifically between 180° and 250° around the longitudinal axis A-A with the remainder being a closed space that facilitates flow of excess fluid into the collection trough 201 as described in greater detail below. The air stream generated by the fan device 310 generally flows upward through the air flow passageway 125 and through the central apertures 325 of the bubble generating devices 321. Thus, as best seen in FIG. 6, the central apertures of the bubble generating devices 321 are aligned with the air flow passageway 125 and remain aligned with the air flow passageway 125 as the bubble generating assembly 320 rotates about the rotational axis as described herein.

The space between the first inner annular wall 120 and the outer annular wall 101 forms an excess fluid passageway 126 through which excess amounts of the bubble solution can flow into the collection trough 201 of the drip tray 200. The first inner annular wall 120 is attached to the outer annular wall 101 along a bottom edge of the first inner annular wall 120 to form a floor 127 of the excess fluid passageway 126. Furthermore, a plurality of openings 128 are formed into the floor 127 of the excess fluid passageway 126 so that the excess bubble solution can flow therethrough and into the collection trough 201. The openings 128 are circumferentially spaced apart in the exemplified embodiment, but could be a single elongated opening in other embodiments so long as an opening exists for the excess bubble solution to flow out of the excess fluid passageway 126 and into the collection trough 201. As best seen in FIG. 2, a cross-sectional area of the excess fluid passageway 126 continuously increases moving in a direction from the collection trough 201 to a distal end 111 of the housing 100. This occurs in the exemplified embodiment due to the outer annular wall 101 being angled/inclined whereas the first inner annular wall 120 is vertical. By varying the cross-sectional area of the excess fluid passageway 126 in this way, any excess fluid flowing therethrough is forced to the floor 127 and through the openings 128 therein so that it can flow into the collection trough 201 below. This flow of the excess amounts of the bubble solution will be described in greater detail below with reference to FIGS. 2, 14A, and 14B.

Referring to FIGS. 1, 2, 6A and 6B, the bubble solution dispenser 400 and the support member 450 will be described in greater detail. In the exemplified embodiment, the support member 450 is pivotably coupled to the bubble solution dispenser 400. Thus, the support member 450 can be pivoted or rotated relative to the bubble solution dispenser 400 (and relative to the housing 100 because the bubble solution dispenser 400 is fixedly coupled to the housing 100 in the exemplified embodiment) about an axis B-B that is perpendicular to and non-coplanar with the longitudinal axis A-A of the housing 100. Specifically, the support member 450 is pivotable relative to the bubble solution dispenser 400 and relative to the housing 100 between a non-dispensing position, shown in FIG. 6A, and a dispensing position, shown in FIG. 6B.

As noted previously and discussed in more detail below, the support member 450 is configured to support a container of the bubble solution. Thus, when the support member 450 is in the non-dispensing position and is supporting the container, the container is in a substantially upright orientation such that it is prevented from dispensing the bubble solution into the bubble solution dispenser 400. When the support member 450 is in the dispensing position and is supporting the container, the container is in a substantially upside-down orientation such that it dispenses the bubble solution contained therein into the bubble solution dispenser 400. This will be described in greater detail below with reference to at least FIGS. 2 and 10.

As noted previously, the bubble solution dispenser 400 comprises a main body portion 401 and a delivery member 410. The main body portion 401 comprises a floor 402 and a sidewall 403 extending upwardly from the floor 402 to define a holding reservoir 404. Furthermore, in the exemplified embodiment the bubble solution dispenser 400 comprises a switch 415 located along the sidewall 403 of the main body portion 401 (the switch 415 is visible in FIGS. 1 and 2). In other embodiments, the switch 415 could be located on the floor 402 or at other locations without affecting the functionality of the apparatus 1000. In some embodiments, the switch 415 may be the only switch provided on the apparatus 1000 for powering the motor 300. Thus, the switch 415 may be alterable between an open state in which the power source 550 is not operably coupled to the motor 300 (i.e., a circuit between the power source 550 and the motor 300 is open) and a closed state in which the power source 550 is operably coupled to the motor 300 to cause the motor 300 to rotate about the rotational axis as described herein. Specifically, when the switch 415 is in the open state the motor 300 is not powered and when the switch 415 is in the closed stat the motor 300 is powered. Thus, the switch 415 operates as a power button for the apparatus 1000. As noted above, in the exemplified embodiment the switch 415 is the only power button on the apparatus 1000, and thus actuation of the switch 415 is required to operate the apparatus 1000 and is the only manner in which the apparatus 1000 may be powered on.

In the exemplified embodiment, the switch 415 is a momentary-type switch. Thus, the switch 415 is biased into an open state such that no power is transmitted from the power source 550 to the motor 300. Stated another way, the switch 415 is normally open and is only closed when the switch 415 is being actuated or engaged or pressed. In a momentary-type switch, a force must be applied onto the switch to close the switch and supply power to the motor 300 and a cessation or release of the force causes the switch 415 to bias back into the open (or off) state. Thus, in the exemplified embodiment when a force is applied onto the switch 415 power is transmitted to the motor 300 and when no force is applied onto the switch 415 no power is transmitted to the motor 300. Of course, in other embodiments the switch 415 may be an alternate action switch (such as a flip switch, a toggle switch, or the like), whereby the switch must be "flipped" to be altered into a continuous on/off state. In such embodiments, in one position of the switch the switch is closed and power is transmitted to the motor 300 an in another position of the switch the switch is open and no power is transmitted to the motor 300. While both different types of switches may be used, in the exemplary embodiment the switch 415 is a momentary-type switch and it is biased into the open state (i.e., a normally open momentary-type switch) such that no power is transmitted from the power source 550 to the motor 300 unless a force is applied onto the switch 415 to actuate the switch 415 into the closed state.

The support member 450 comprises an upstanding wall 451 having a front opening 452 through which a container of bubble solution may be passed. The upstanding wall 451 has an arcuate shape but extends for only part of a ring or loop, thereby leaving the front opening 452 open. The upstanding wall 451 comprises an inner surface 453 that defines a support cavity 454 within which a portion of the container 500 of bubble solution can be supported. Furthermore, there is a ledge 455 extending from the inner surface 453 of the upstanding wall 451 into the support cavity 454 for purposes of supporting the container 500. In the exemplified embodiment, the ledge 455 comprises a plurality of spaced apart ledge segments, although a singular continuous ledge member could be used in other embodiments. When the container 500 is supported by the support member 450, a protrusion on the neck of the container 500 is typically supported atop of the ledge 455 as best shown in FIG. 2. Furthermore, the upstanding wall 451 is somewhat flexible, such that it flexes outwardly as the container 500 is being inserted into the support cavity 454 and then snaps back into a tight fit against the container 500 to hold it in place.

Figure 6B:
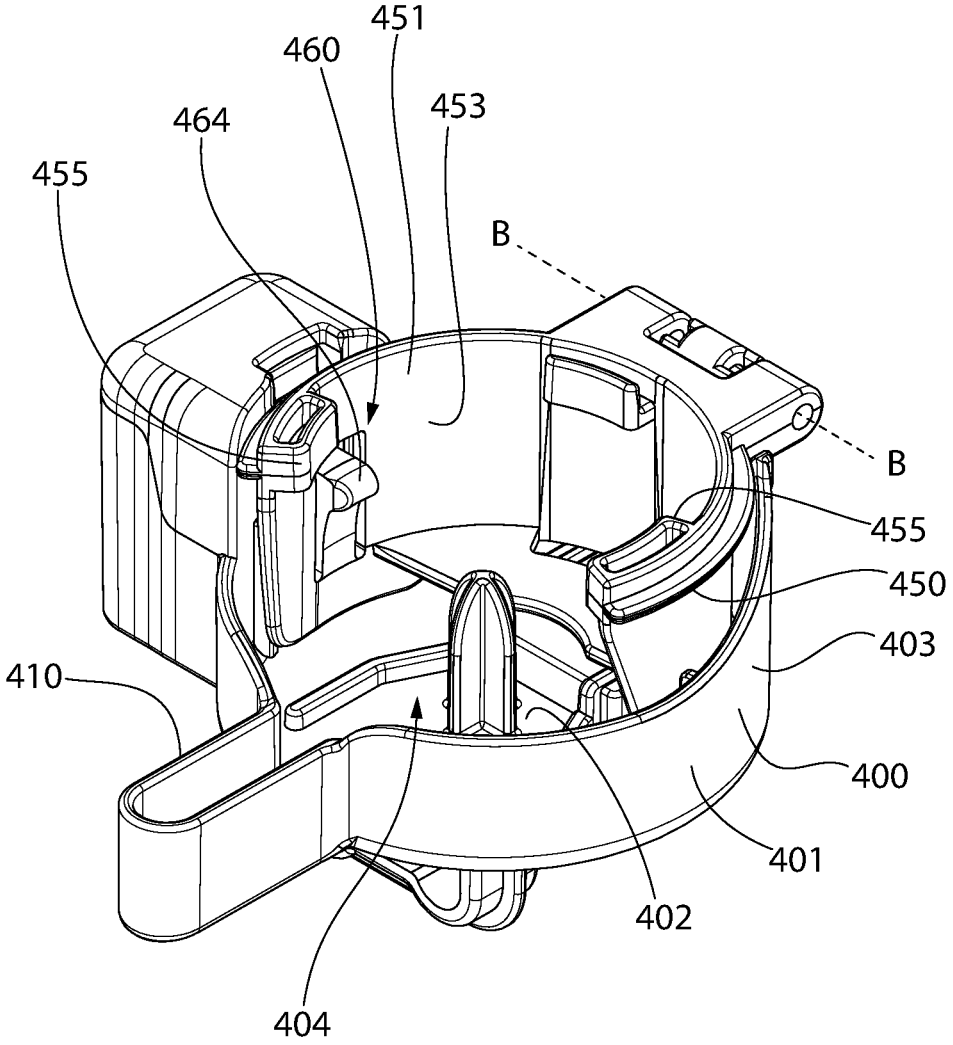

The support member 450 further comprises an actuation member 460 that is configured to actuate the switch 415 on the bubble solution dispenser 450 when the support member 450 is in the dispensing position shown in FIG. 6B. In the exemplified embodiment, the actuation member 460 comprises a flexible tab 461 that is formed by a U-shaped slit 462 extending through the upstanding wall 451. Thus, the flexible tab 461 is able to flex inwardly into the support cavity 454 and outwardly away from the support cavity 454 in response to forces acting thereon. In the exemplified embodiment, the flexible tab 461 comprises a body portion 463, a first tab portion 464 that protrudes from an inner surface of the upstanding wall 453 and into the support cavity 454, and a second tab portion 465 that protrudes from an outer surface of the upstanding wall 453 in a direction away from the support cavity 454. In some embodiments, the switch 415 and the actuation member 460 may be collectively referred to herein as an actuation assembly.

As described in greater detail below, when the container 500 is being supported by the support member 450, the container 500 contacts the first tab portion 464 of the flexible tab 461 and flexes the flexible tab 461 radially outward in a direction away from the support cavity 454. Specifically because the first tab portion 464 protrudes into the support cavity 454, when the container 500 is disposed within the support cavity 454 the container 500 contacts the first tab portion 464 and presses it outwardly. This causes the second tab portion 465 to extend further from the outer surface of the upstanding wall 455. Thus, when there is no container in the support cavity 454, the flexible tab 461 is in its biased state whereby the second portion 465 of the flexible tab 461 extends a first distance from an outer surface of the upstanding wall 451. When the container 500 is located in the support cavity 454 and supported by the support member 450, the flexible tab 461 is flexed outwardly so that the second portion 465 of the flexible tab 461 extends a second distance from the outer surface of the upstanding wall 451, with the second distance being greater than the first distance.

In the exemplified embodiment, the outward flexing of the flexible tab 461 when the container 500 is being supported by the support member 450 is what causes the flexible tab 461 of the actuation member 460 to actuate the switch 415. Specifically, in some embodiments when the support member 450 is not supporting a container, putting the support member 450 into the dispensing position will not result in the actuation member 460 actuating the switch 415. This is because in such embodiments when the container 500 is not supported by the support member 450, the second portion 465 of the flexible tab 461 does not protrude far enough from the upstanding wall 451 to engage the switch 415. However, when the support member 450 is supporting the container 500, putting the support member 450 into the dispensing position will result in the actuation member 460 actuating the switch 415. Specifically, because the second portion 465 of the flexible tab 461 extends further from the upstanding wall 451 when the container 500 is located in the support cavity 454, the second portion 465 of the flexible tab 461 is able to contact/engage the switch 415 with a sufficient force to actuate the switch 415 and power the apparatus 1000 on.

Thus, in some embodiments the apparatus 1000 is only powered on when: (1) the support member 450 is supporting the container 500 and the support member 450 is in the dispensing position; or (2) a user manually presses the switch 415. However, because the switch 415 is a momentary type switch in the exemplified embodiment, requiring a user to have a continuous hold on the switch 415 during operation is undesirable. Thus, having the support member 450 achieve the actuation of the switch 415 is desirable. This also ensures that any time the container 500 is supported by the support member 450 in the dispensing position so it is dispensing the bubble solution into the bubble solution dispenser 400, the apparatus 1000 is powered on, thereby preventing the bubble solution from simply flowing into the housing 100 during times of non-operation. To state it succinctly, anytime that the support member 450 is supporting the container 500 in the dispensing position (e.g., FIGS. 6B, 9, and 10), the switch 415 will be actuated into the closed state and power will be transmitted from the power source 550 to the motor 300.

Figure 7A:
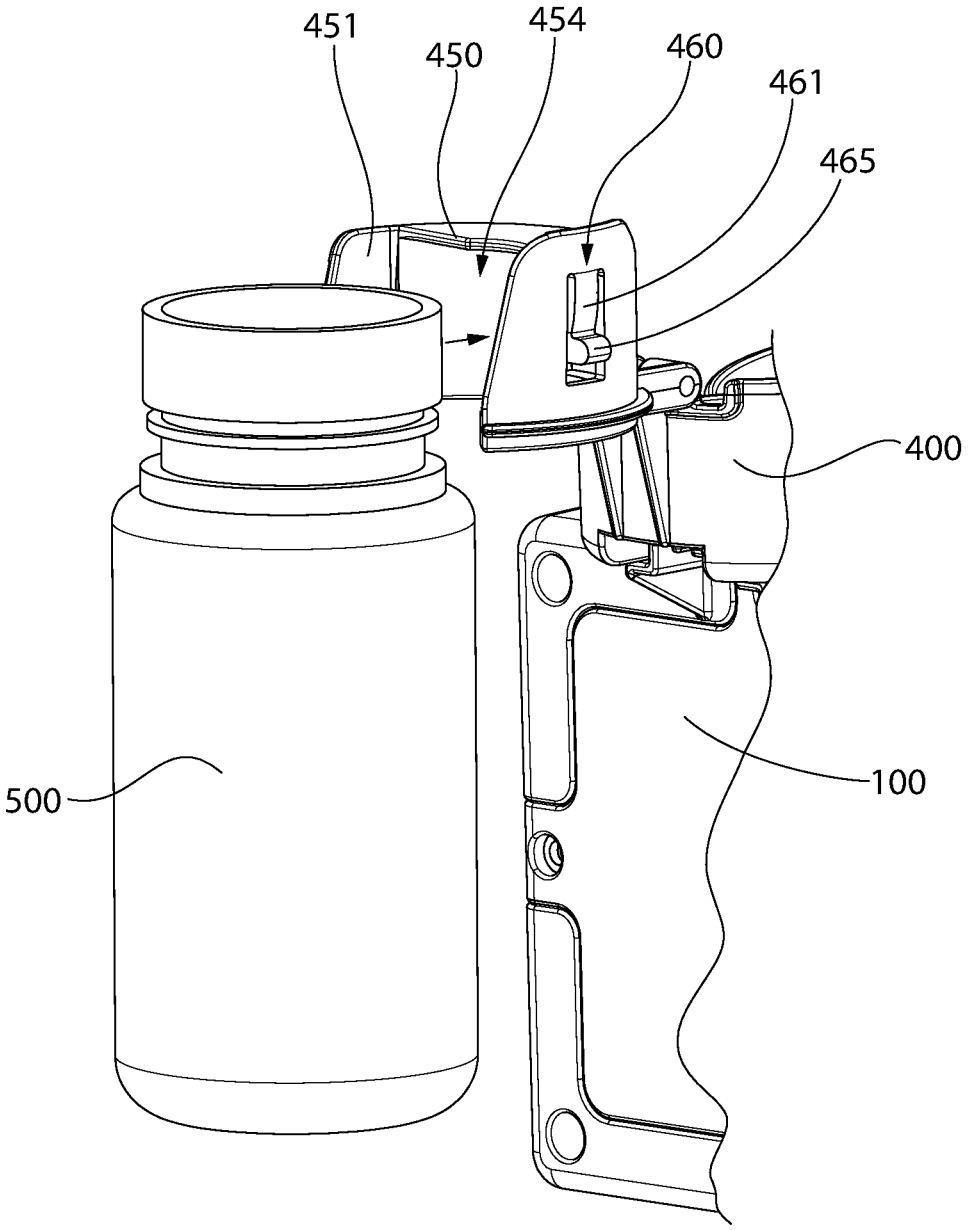
FIGS. 7A and 7B are partial perspective views illustrating a container of bubble solution being supported by the support member.
Figure 7B:
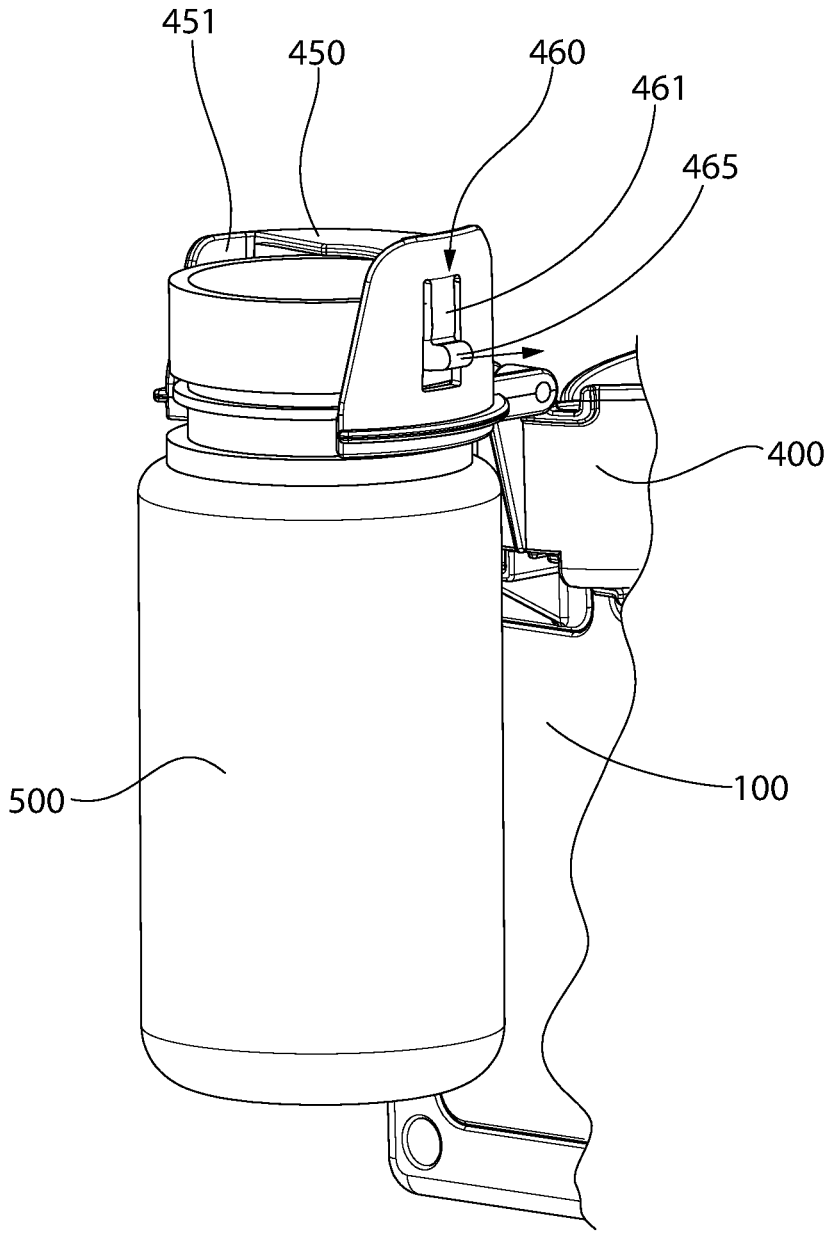

Turning to FIGS. 7A and 7B, illustrations are provided showing the container 500 being inserted into the support cavity 454 of the support member 450. Specifically, the container 500 is inserted through the front opening 452 in the upstanding wall 451. As the container 500 is so inserted, the upstanding wall 451 may flex slightly to enable the container 500 to be fully inserted into the support cavity 454. Furthermore, once the container 500 is snapped into the support cavity 454, the container 500 presses on the flexible tab 461 of the actuation member 460 and pushes the second tab portion 465 thereof outwardly, as shown by the arrow in FIG. 7B.

Figure 8:
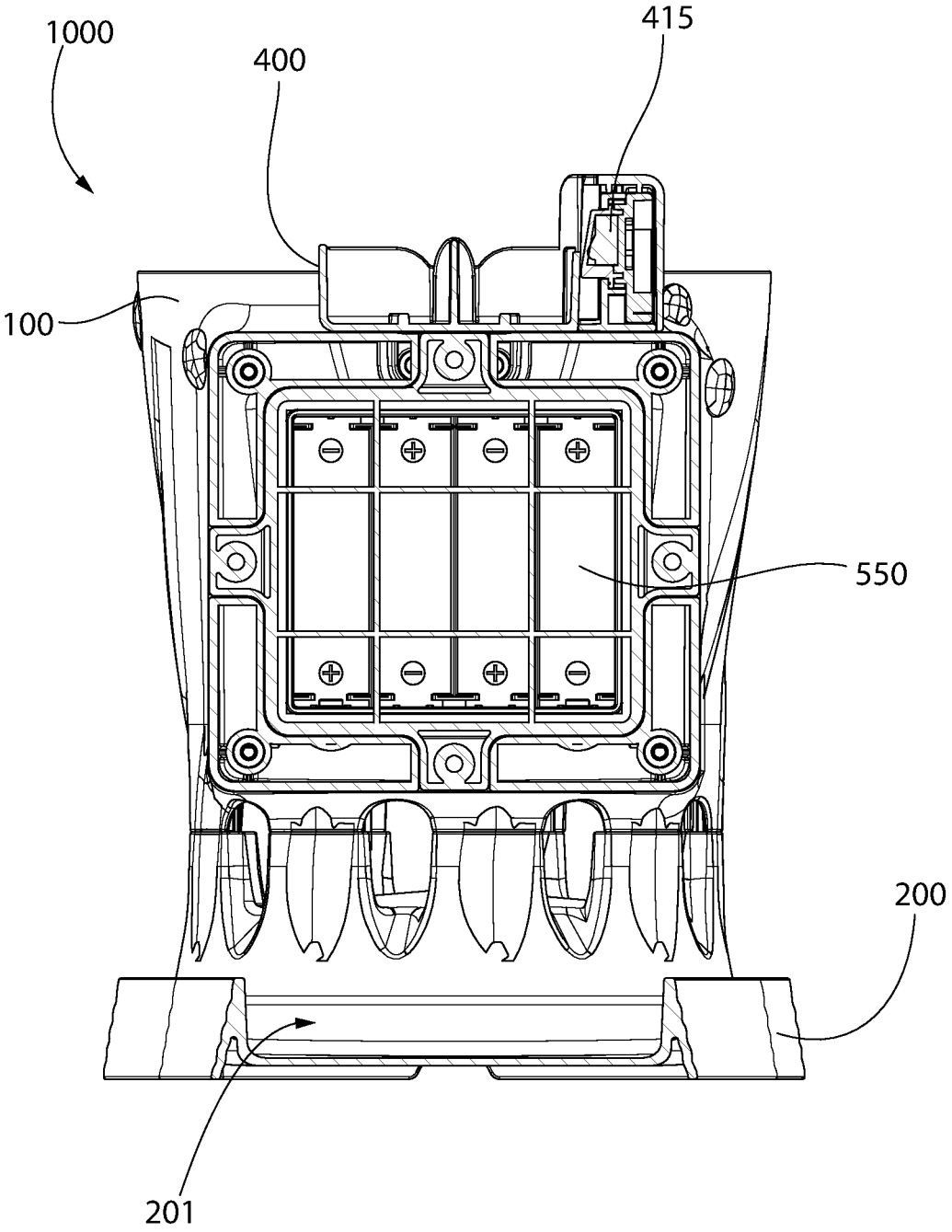
FIG. 8 is a cross-sectional view taken along line VIII-VIII of FIG. 2.

Next, referring to FIGS. 1, 2, and 8, the apparatus 1000 is illustrated in a perspective view and various cross-sectional views with the support member 450 in the non-dispensing position. The support member 450 is supporting the container 500 as previously described and shown in FIGS. 1 and 2. As noted, when the support member 450 is in the non-dispensing position, the bubble solution container 500 is substantially upright. As used herein, the term substantially upright indicates a position whereby the bubble solution container 500 cannot dispense the bubble solution contained therein by gravity alone. Thus, the term substantially upright may be somewhat dependent on the amount of bubble solution contained therein, because a container can be tilted more without spilling its contents when it contains a lower volume of the contents. In some embodiments, the term "substantially upright" includes the container 500 being oriented so that its longitudinal axis C-C is at an angle of between 45° and 135° relative to a horizontal plane with its top dispensing end 502 facing away from a ground surface (the ground surface being any surface upon which the apparatus 1000 is resting during normal use and operation of the apparatus 1000).

As seen in FIGS. 1, 2, and 8, when the support member 450 is supporting the container 500 in the non-dispensing position, the switch 415 is not being actuated. Thus, in embodiments whereby the switch 415 is a momentary switch, the switch 415 is in its "off" state or open state such that no power is being transmitted from the power source 550 to the motor 300. Similar results can be achieved when the switch 415 is an alternate action switch.

Figure 9:
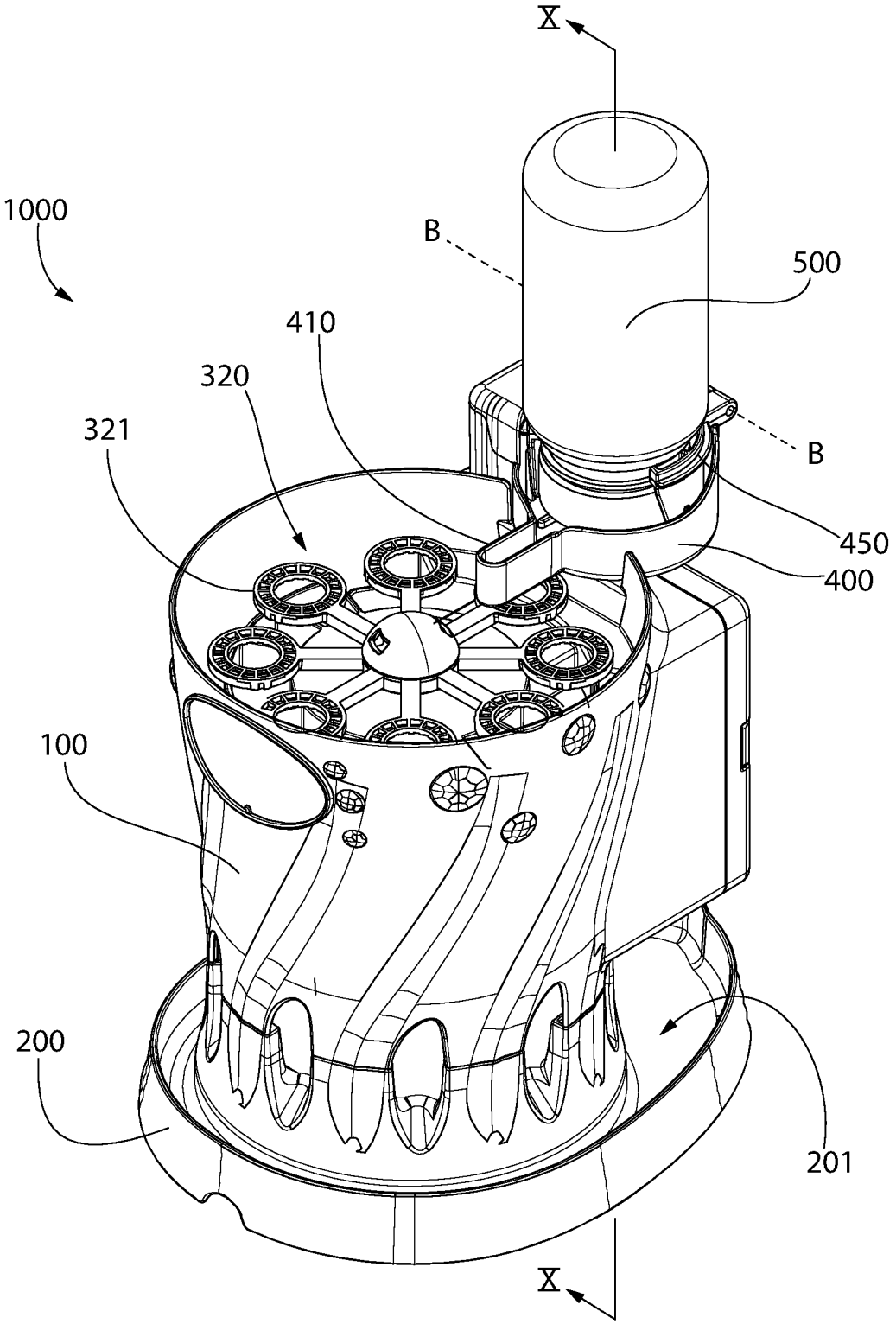
FIG. 9 is a front perspective view of the apparatus of FIG. 1, wherein the support member is supporting the container of bubble solution in a dispensing position.
Figure 10:
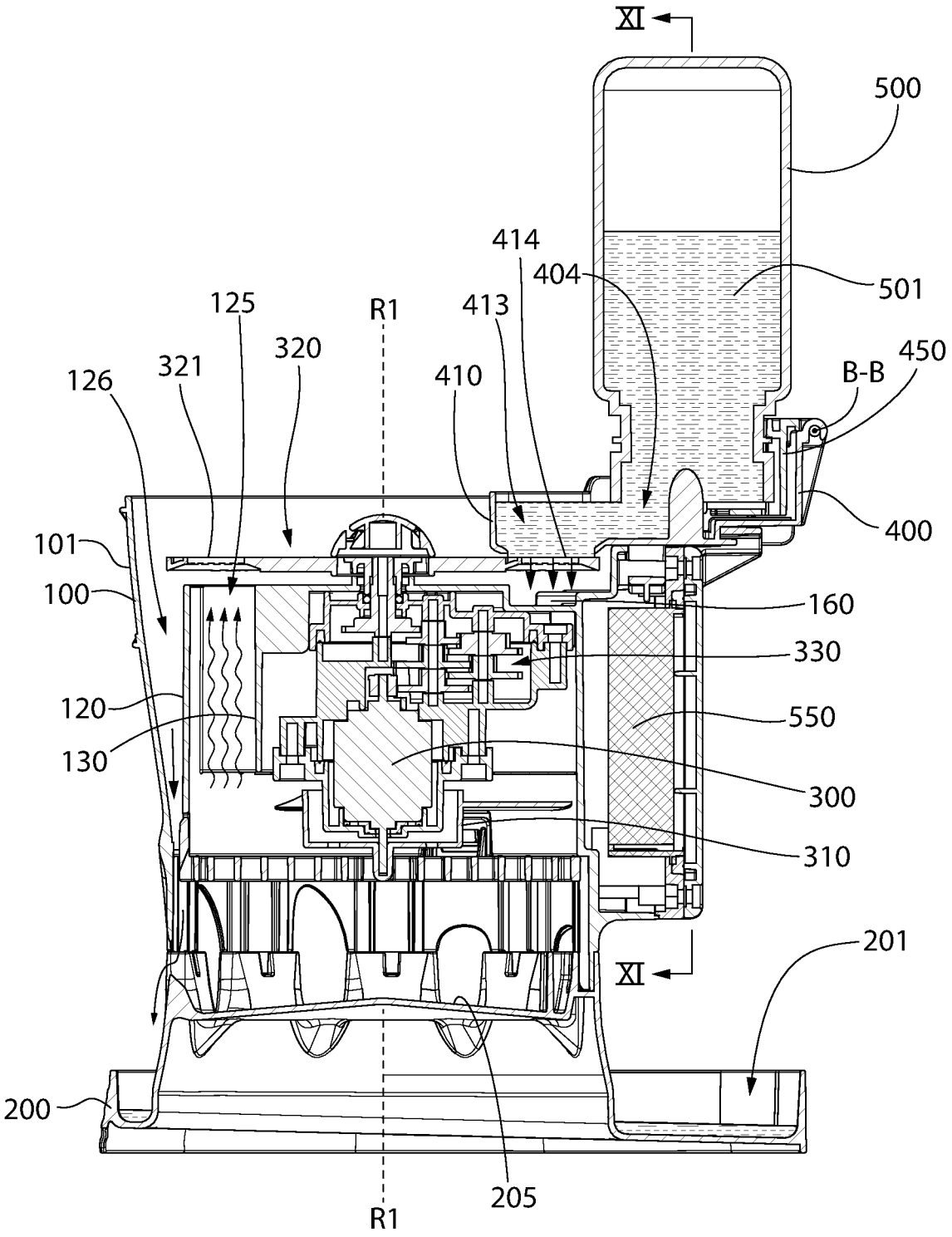
FIG. 10 is a cross-sectional view taken along line X-X of FIG. 9.
Figure 11:
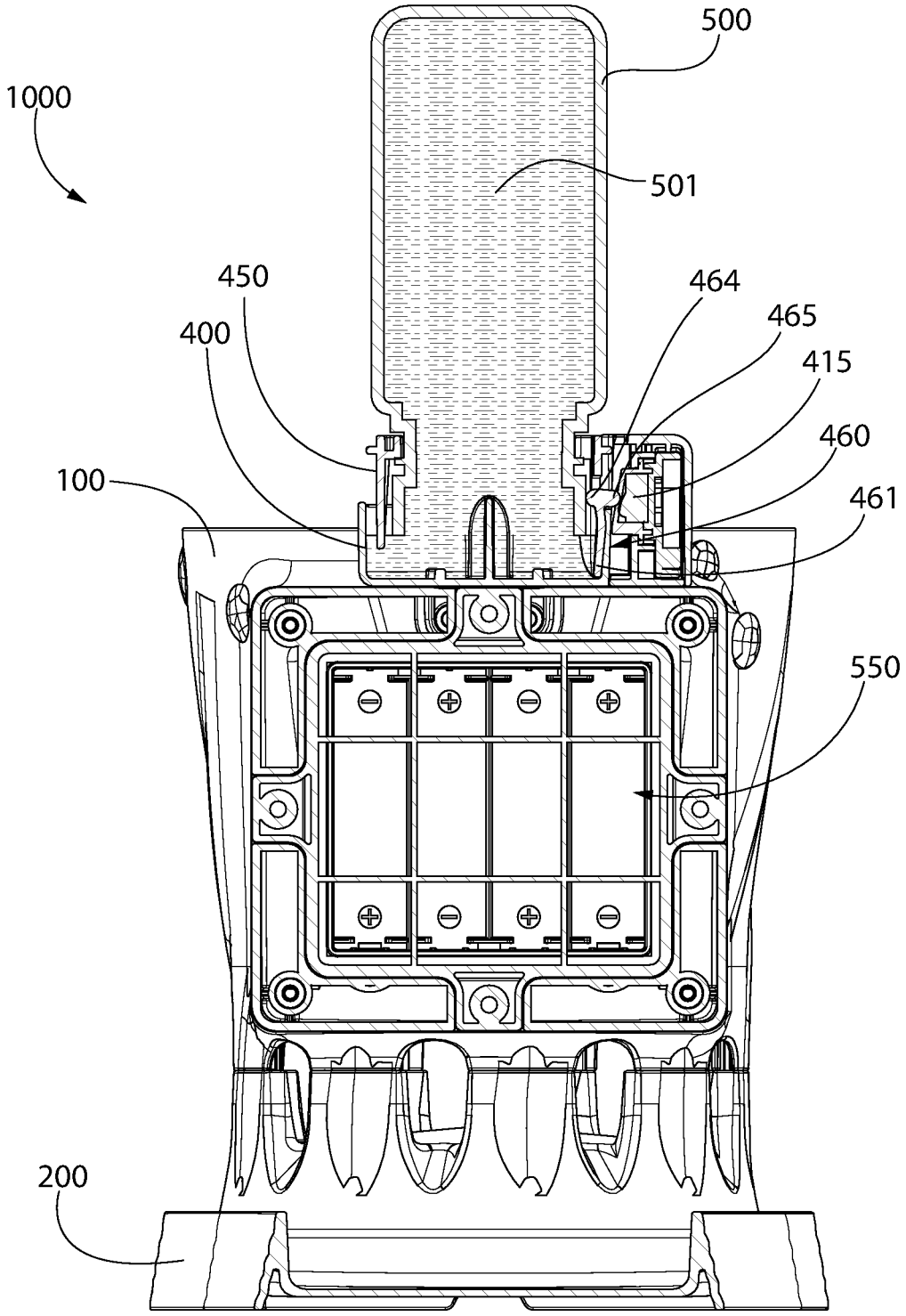
FIG. 11 is a cross-sectional view taken along line XI-XI of FIG. 10, illustrating actuation of a switch to power on the apparatus.

Referring to FIGS. 9-11, the apparatus 1000 is illustrated in a perspective view and various cross-sectional views with the support member 450 supporting the container 500 and being in the dispensing position. In the exemplified embodiment, the support member 450 is pivotably coupled to the bubble solution dispenser 400. Thus, in the exemplified embodiment altering the support member 450 from the non-dispensing position to the dispensing position comprises rotating or pivoting the support member 450 about the axis B-B. Of course, in other embodiments the support member 450 may be slidably coupled to the bubble solution dispenser 400 so as to be slid between the dispensing and non-dispensing positions. In still other embodiments, the support member 450 may not be attached to the bubble solution dispenser 400 at all, but may instead simply be placed into the holding reservoir 404 when desired for use.

When the support member 450 is supporting the container 500 and altered into the dispensing position, the bubble solution 501 begins to flow out of the container 500 and into the holding reservoir 404 of the bubble solution dispenser and from the holding reservoir 404 into the delivery reservoir 413 of the delivery member 410. This is because the container 500 is in an upside-down or substantially upside-down orientation whereby a dispensing end of the container 500 is facing downward. The container 500 need not be completely vertical and upside-down, but rather needs to be positioned and oriented in such a manner that the bubble solution 501 will readily flow out of the container 500 and into the holding reservoir 404.

From the delivery reservoir 413, the bubble solution flows out of the slit 414 and onto the bubble generating devices 321 of the bubble generating assembly 320. Furthermore, when the support member 450 is supporting the container 500 in the dispensing position, the motor 300 is operating and rotating. Thus, the fan device 310 and the bubble generating assembly 320 are also rotating about a rotational axis R1-R1 due to their operable coupling to the motor 300. Thus, as the bubble solution becomes loaded on the bubble generating devices 321, the bubble generating devices 321 rotate into alignment with the air flow passageway 125 so that the air stream generated by the fan device 310 blows through the bubble generating devices 321 and converts the bubble solution into bubbles.

As noted above, when the support member 450 is supporting the container 500 and is in the dispensing position, the switch 415 is automatically actuated into the closed state and the motor 300 is powered. In the exemplified embodiment, this occurs as follows. When the support member 450 is altered, pivoted, rotated, or the like into the dispensing position, the second tab portion 465 of the flexible tab 461 contacts the switch 415 and presses against the switch 415. This pressure/force applied onto the switch 414 alters the switch 415 from its biased/normal open state to a closed state, which in turn causes power from the power source 550 to be transmitted to the motor 300. As noted above, the container 500 is in contact with the first tab portion 464 of the flexible tab 461, which prevents the flexible tab 461 from simply flexing away from the switch 415 but instead ensures that the second portion 465 of the flexible tab 461 will contact the switch 415 with sufficient force to actuate the switch 415 into the closed state. Thus, anytime the support member 450 is supporting the container 500 and is altered into the dispensing position, the switch 415 will be actuated into the closed state to supply power from the power source 550 to the motor 300 to initiate operation of the apparatus 1000. This ensures bubble solution is not flowing out of the container 500 and into the apparatus 1000 without the apparatus 1000 and motor 300 being powered on.

It should be noted that opposite motion/movement of the support member 450 relative to the bubble solution dispenser 400 has the opposite effect in that it alters the switch 415 from the closed state (i.e., on state) to the open state (i.e., off state). Specifically, in the exemplified embodiment, altering or pivoting the support member 450 from the dispensing position to the non-dispensing position will remove contact between the actuation member 460 and the switch 415, which will cause the switch 415 to alter into the open state (when the switch 415 is a momentary-type switch). In other embodiments where the switch 415 is an alternate action switch, the action of moving the support member 450 from the dispensing position to the non-dispensing position will toggle the switch 415 (rather then simply removing force from being applied onto the switch) to alter the switch 415 from the closed state to the open state. In either case, altering/pivoting the support member 450 from the dispensing position (FIG. 11) to the non-dispensing position (FIG. 8) will alter the switch from the closed state (on state) to the open state (off state) so that power is no longer transmitted from the power source 550 to the motor 300.

Figure 12A:
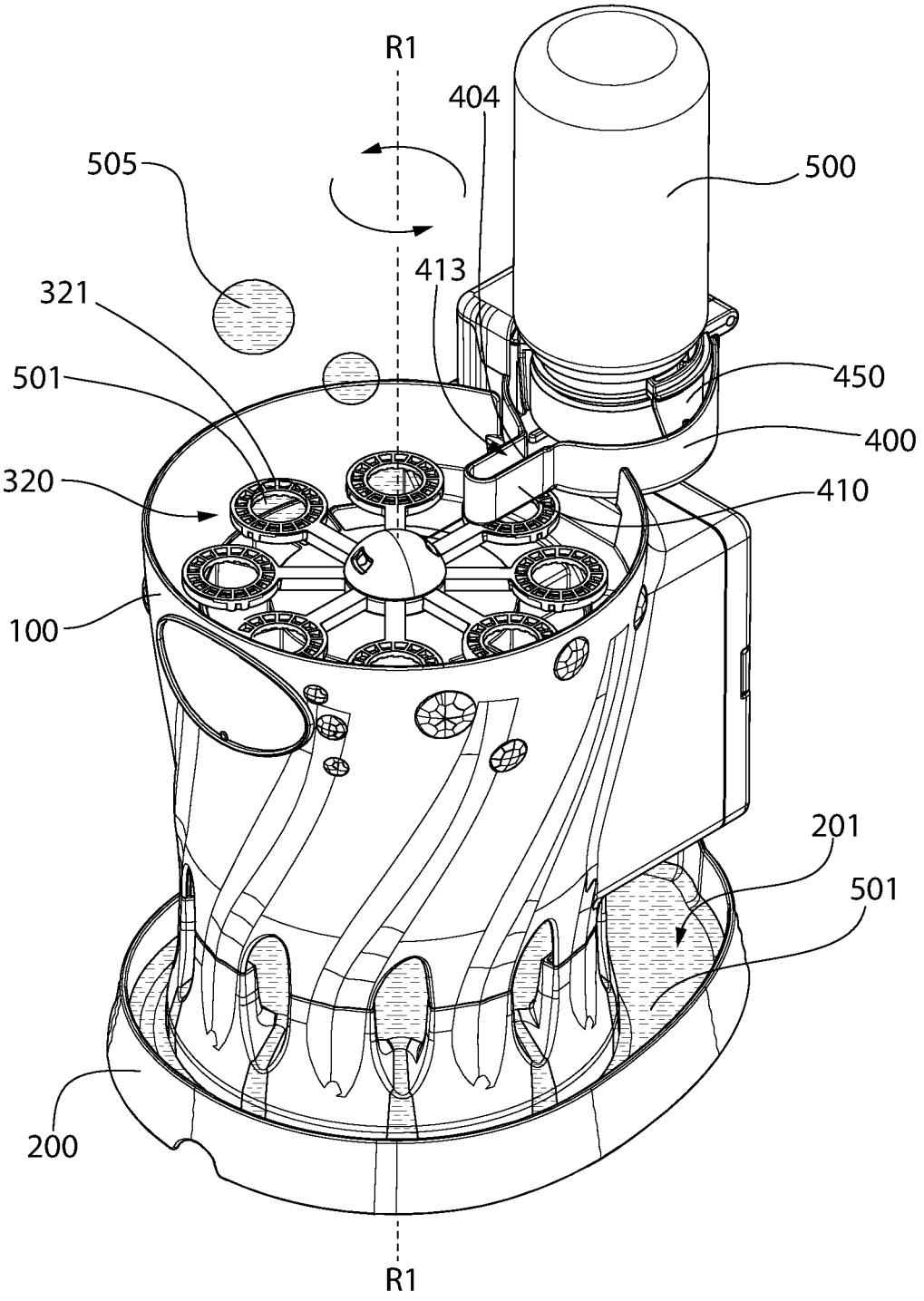
FIGS. 12A and 12B are perspective views of the apparatus of FIG. 1 illustrating its operation to generate bubbles.
Figure 12B:
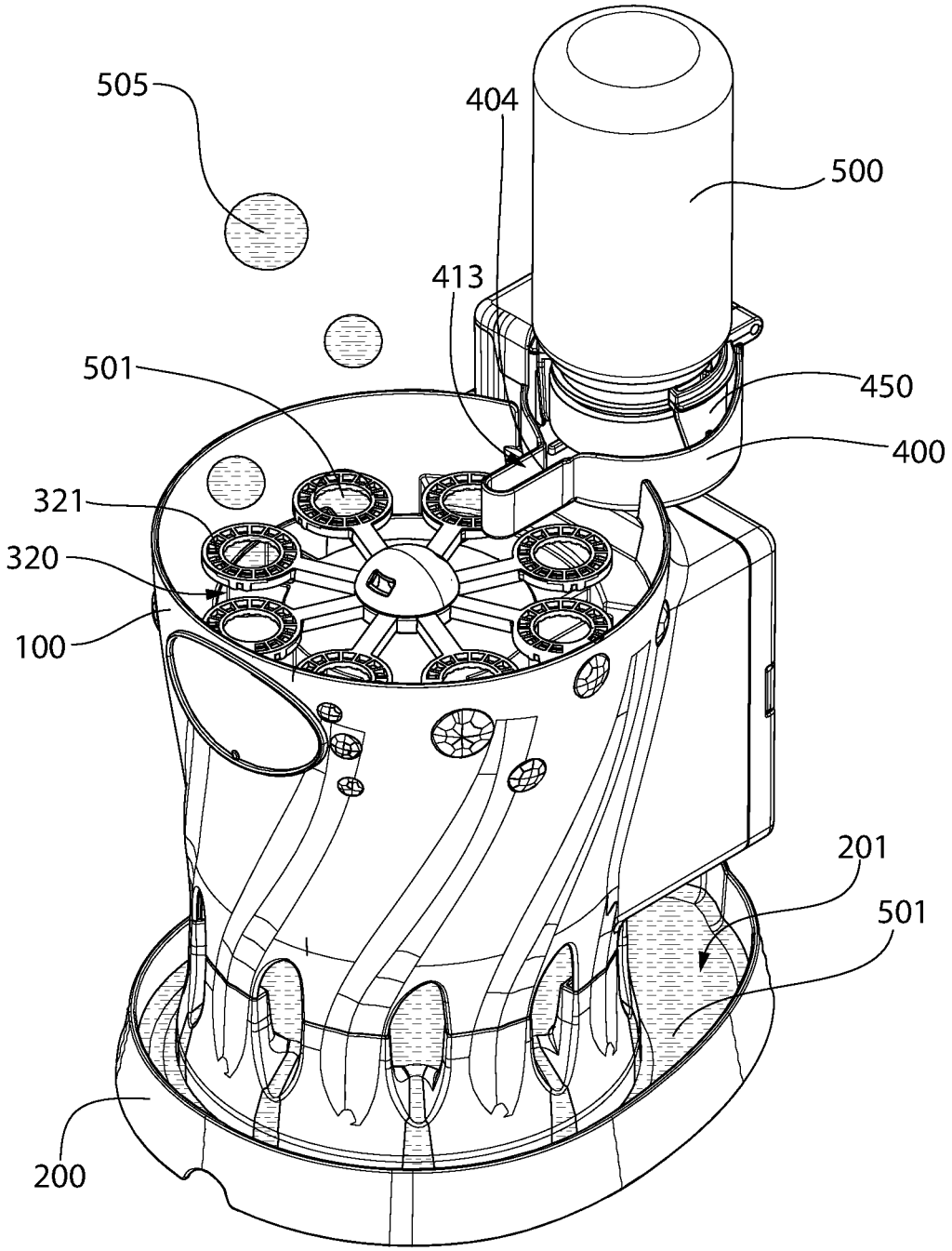
Figure 13:
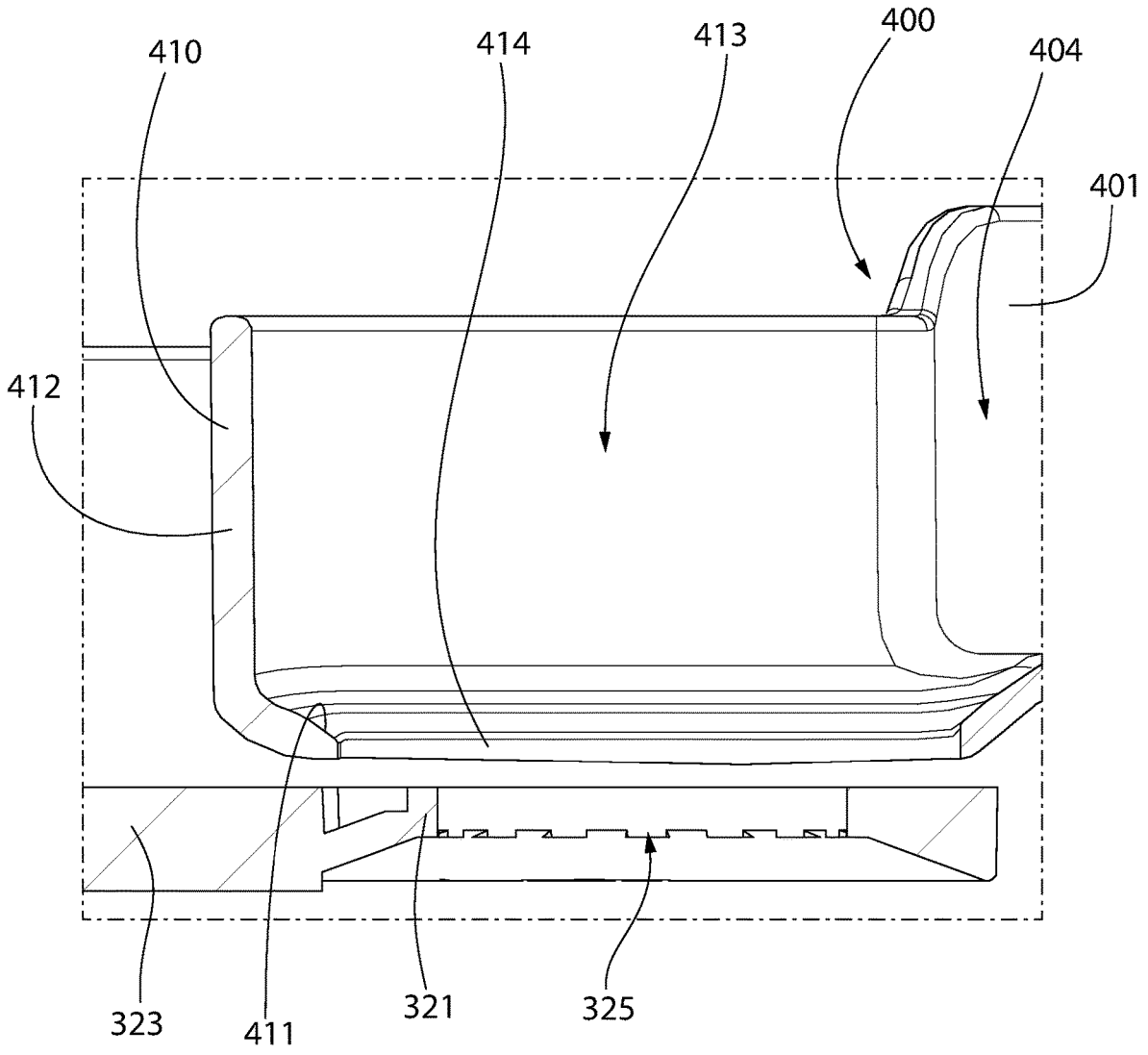
FIG. 13 is a close-up view of area XIII of FIG. 2.

Referring to FIGS. 12A, 12B, and 13, operation of the apparatus 1000 to generate bubbles will be described. In FIGS. 12A and 12B, the support member 450 is supporting or holding the container 500 with the container 500 containing a supply of the bubble solution 501 and the support member 450 is in the dispensing position. Thus, the bubble solution 501 flows out of the container 500 and into the holding reservoir 404 and from the holding reservoir 404 into the dispensing reservoir 413. From the dispensing reservoir 413, the bubble solution 501 flows through the slit 414 where it is dispensed onto the bubble generating devices 321 of the bubble generating assembly 320. Furthermore, as noted above, when the support member 450 is supporting the container 500 and is in the dispensing position, the switch 415 is actuated into the closed state. Thus, as the bubble solution 501 is being dispensed onto the bubble generating devices 321, the bubble generating devices 321 (and the bubble generating assembly 320 as a whole) is rotating about the rotational axis R1-R1 and the fan device 310 is rotating about the rotational axis R1-R1. Thus, the bubble generating devices 321 rotate into alignment with the delivery member 410 of the bubble solution dispenser 400 to become loaded with the bubble solution 501 (see, for example, FIG. 13) and then continue to rotate into alignment with the air flow passageway 125 so that the air stream generated by the fan device 310 can pass through the bubble generating devices 321 and generate bubbles 505 from the bubble solution 501 loaded thereon.

As seen in FIGS. 12A and 12B, as the above operation is taking place, excess amounts of the bubble solution 501 is falling into the collection trough 201 of the drip tray 200. Specifically, a continuous flow of the bubble solution 501 is made to flow through the slit 414 in the delivery member 410 of the bubble solution dispenser 400. Furthermore, the bubble generating devices 321 are arranged in a circumferentially spaced apart manner such that there are gaps between adjacent ones of the bubble generating devices 321. Thus, a portion of the bubble solution 501 will be dispensed from the delivery member 410 of the bubble solution dispenser 400 but will not be loaded onto one of the bubble generating devices 321. Instead this portion of the bubble solution 501 will be collected in the collection reservoir 201 of the drip tray 200 so that it can be poured back into the container 500 for re-use.

Figure 14A:
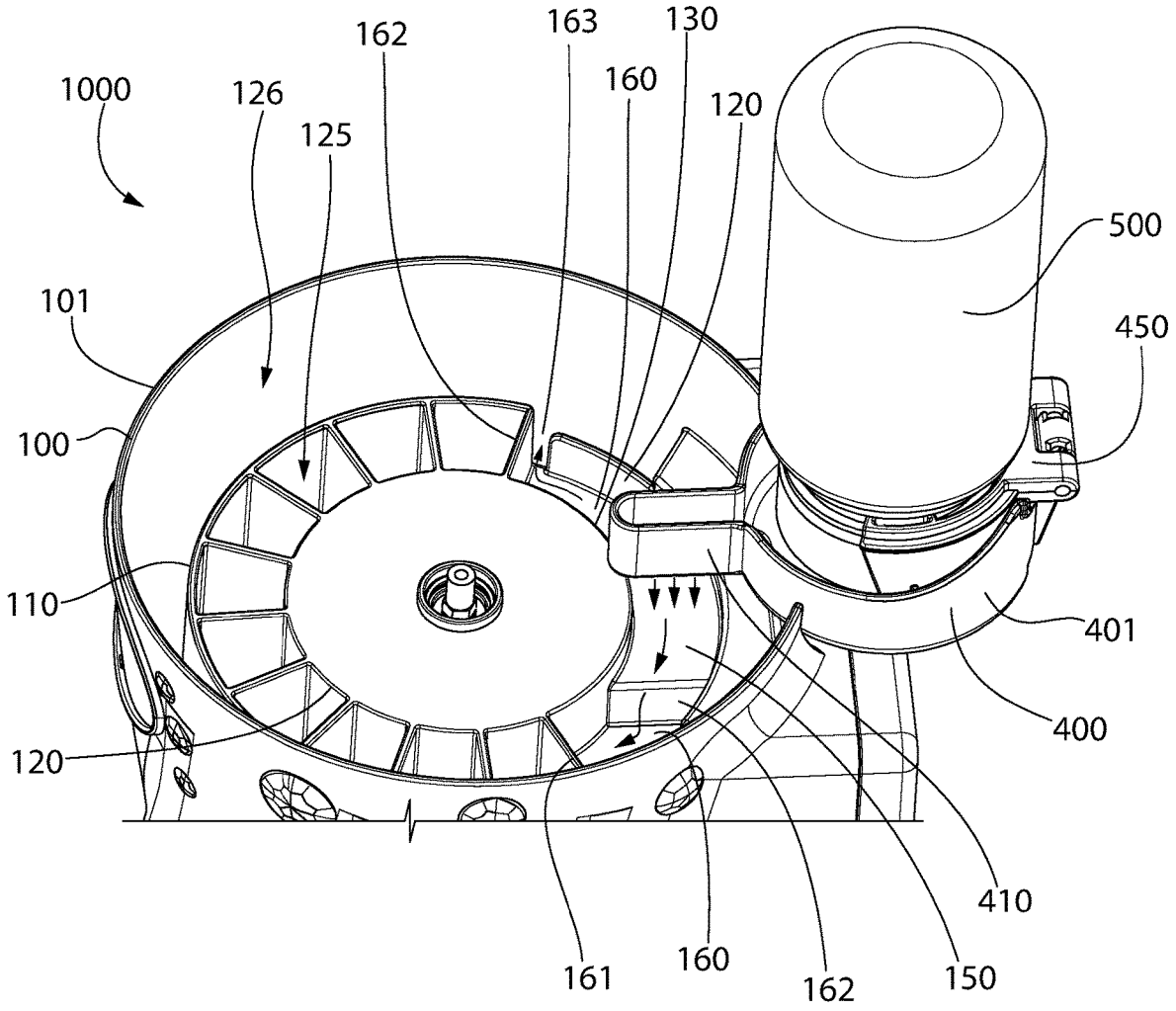
FIG. 14A is a partial top perspective view of the apparatus of FIG. 1 illustrating with arrows a flow of an excess amount of the bubble solution.
Figure 14B:
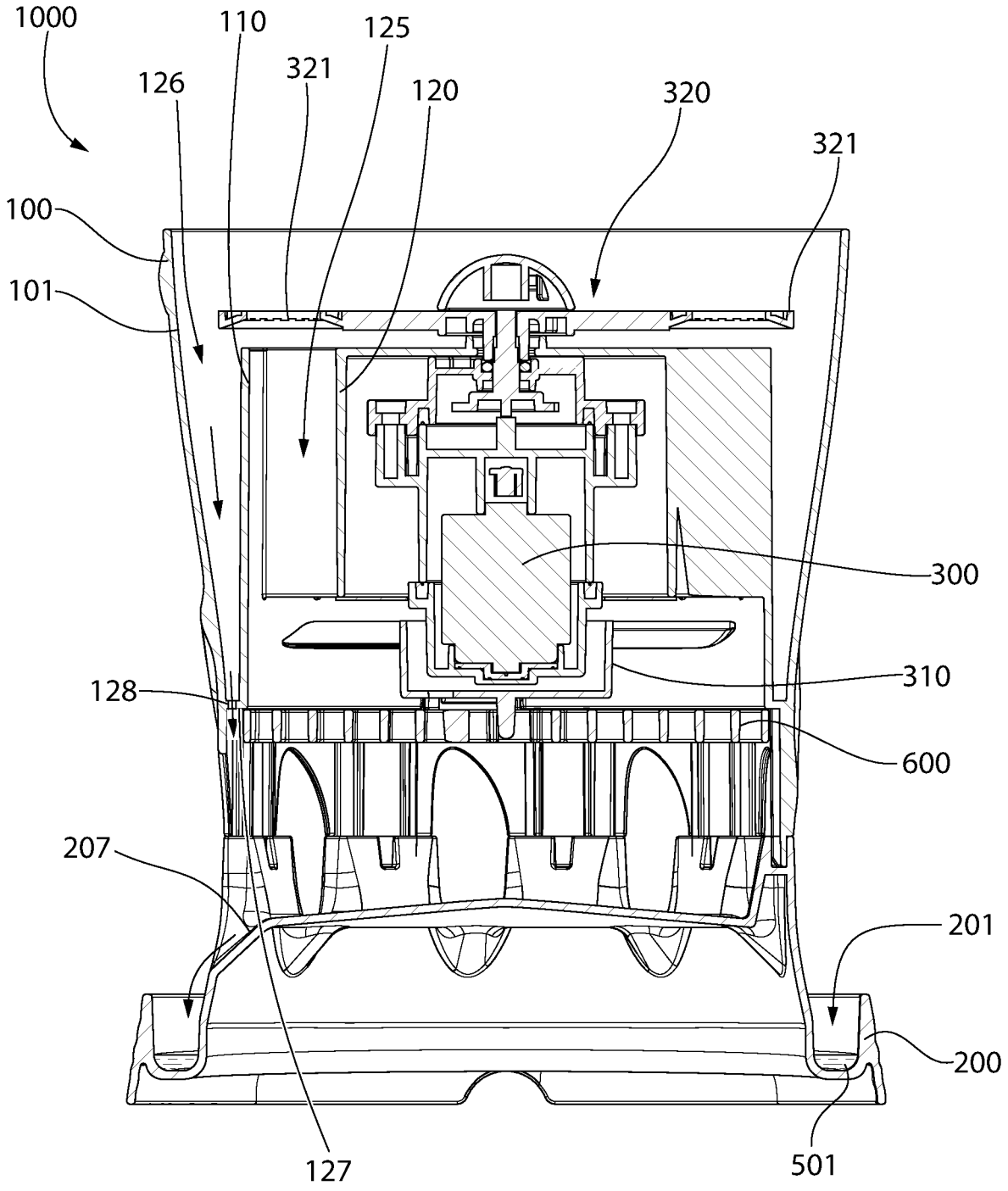
FIG. 14B is a cross-sectional view taken along line XIV-XIV of FIG. 5 illustrating with arrows the flow of the excess amount of the bubble solution.

Referring to FIGS. 10, 14A, and 14B, the flow of the excess amounts of the bubble solution 501 that are dispensed from the delivery member 410 but not loaded onto any of the bubble generating members 321 will be described. The housing 100 comprises at least one funneling reservoir 160 located between the first and second inner annular walls 120, 130. In the exemplified embodiment, there are two of the funneling reservoirs 160. Specifically, the housing 100 comprises a raised platform 150 directly beneath the delivery member 410 and one of the funneling reservoirs 160 on either side of the raised platform 150. The raised platform 150, the funneling reservoirs 150, and the air flow passageway 125 are collectively arranged along a loop or ring extending between the first and second inner annular walls 120, 130. Thus, the funneling reservoirs 160 and the air flow passageway 125 are located along a reference cylinder or a reference ring that is located between the first and second inner annular walls 120, 130.

Each of the funneling reservoirs 160 is defined between a portion of the first inner annular wall 120, a portion of the second inner annular wall 130, a first upstanding wall 161 extending between the first and second inner annular walls 120, 130, and a second upstanding wall 162 extending between the first and second inner annular walls 120, 130. The first and second upstanding walls 161, 162 are circumferentially spaced apart from one another. Furthermore, there is an aperture 163 in the portion of the first inner annular wall 120 that bounds the funneling reservoir 160. The aperture 163 forms a passageway through the first inner annular wall 120 from the funneling reservoir 160 to the excess fluid passageway 126.

Thus, as shown in FIG. 14A, the bubble solution 501 is dispensed from the slit 414 in the delivery member 410 onto the raised platform 150. The bubble solution 501 then flows down to the funneling reservoirs 160, through the aperture 163 in the portion of the first inner annular wall 120, and into the excess fluid passageway 126. Referring to FIGS. 10 and 14B, the bubble solution 501 then flows downwardly within the excess fluid passageway 126 and through the openings 128 in the floor 127 of the excess fluid passageway 126.

Once it flows through the openings 128, the excess bubble solution 501 contacts and flows along the inclined drainage surfaces 207 and then into the collection trough 201 of the drip tray 200. If any of the excess bubble solution 501 flows onto the distal surface 205 of the drainage member 204, it will flow downwardly towards the air flow passageways 106 and down along the inclined drainage surfaces 207. The distal surface 205 of the drainage member 204 may be inclined from a centerpoint to an outer edge to facilitate this flow direction for the excess bubble solution.

Figure 15A:
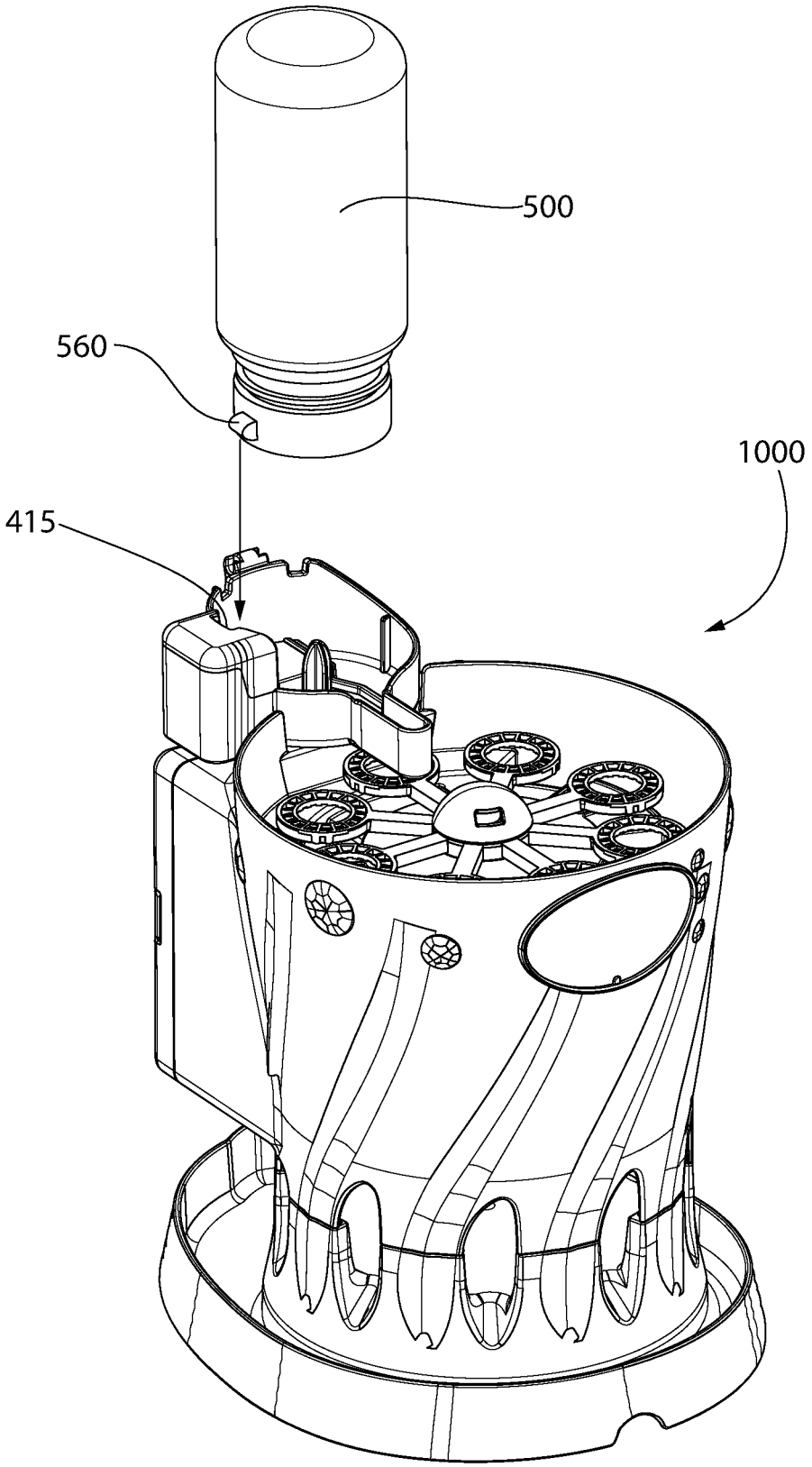
FIGS. 15A and 15B are perspective views of the apparatus of FIG. 1 illustrating an alternative mechanism for actuating a switch thereof.
Figure 15B:
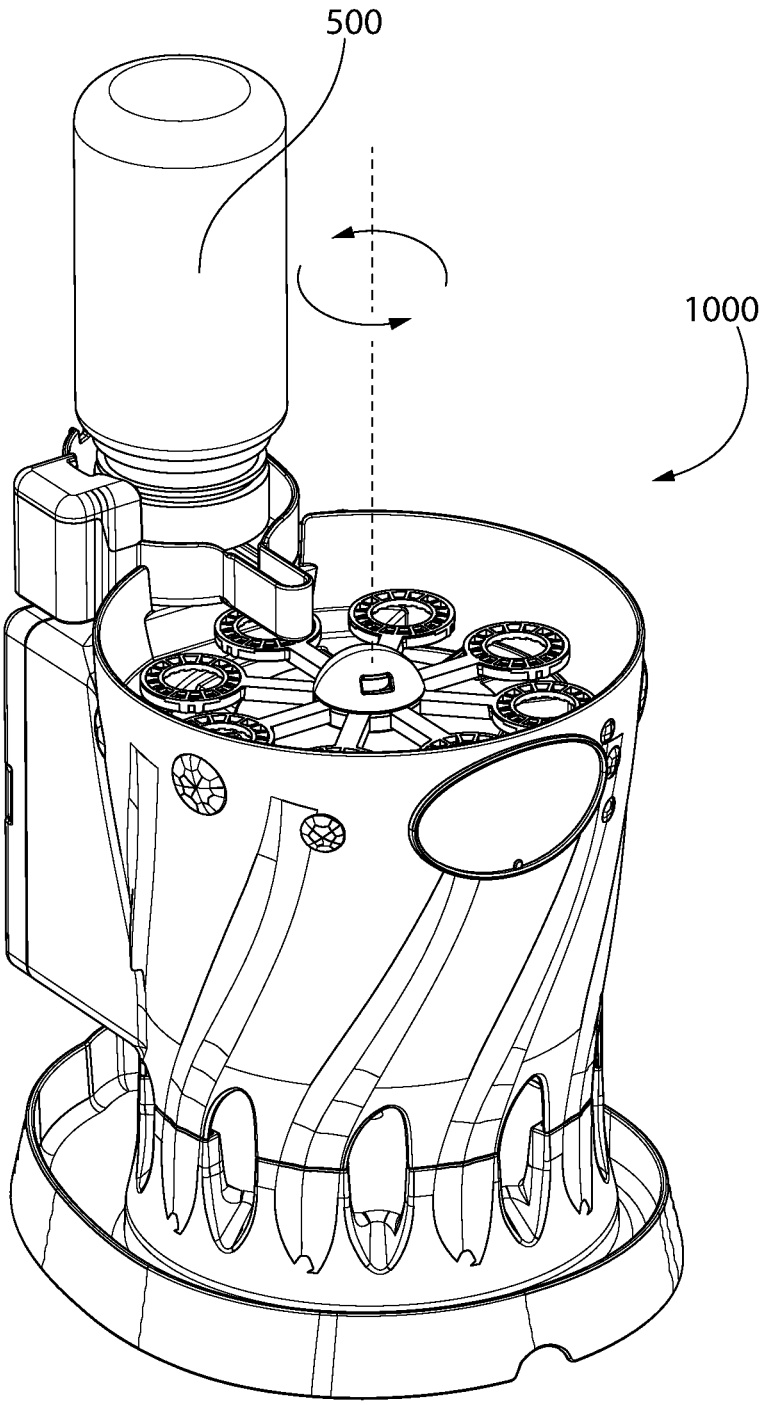

Referring to FIGS. 15A and 15B, an alternative mechanism for actuating the switch 415 will be described. In FIGS. 15A and 15B, the apparatus 1000 is exactly as has been described above, except the support member 450 may be omitted. In this embodiment the container 500 containing the bubble solution can simply be placed upside-down into the holding reservoir 404 of the bubble solution dispenser 400 instead of it being held by the support member 450 and pivoted into position. Because the support member 450 is not used in this embodiment, the actuation member 460 may not be used to actuate the switch 415. Rather, in this embodiment the container 500 comprises an actuation member 560 thereon. The actuation member 560 may be formed as an integral part of the container 500 or it may be formed on a collar or lid that is coupled to the container 500. In any case, when the container 500 is placed in an upside-down orientation within the holding reservoir 404 of the bubble solution dispenser 400, the actuation member 560 will engage and actuate the switch 415 in the same manner as this was accomplished by the actuation member 460 in the previously described embodiment. This will cause the apparatus 1000 to operate with various features rotating as noted above. The bubble solution dispenser 400 and/or the container 500 may also have alignment features in this embodiment to ensure that the container 500 is positioned in an appropriate orientation so that the actuation member 560 engages the switch 415.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An apparatus for generating bubbles comprising:

a housing extending along a longitudinal axis;

a motor positioned in the housing;

a fan device operably coupled to the motor to generate an air stream;

a bubble generating assembly comprising at least one bubble generating device that is aligned with the air stream generated by the fan device;

a bubble solution dispenser comprising at least one delivery member for delivering bubble solution to the at least one bubble generating device;

a support member configured to support a bubble solution container containing a bubble solution, the support member alterable between a non-dispensing position wherein the bubble solution does not flow out of the bubble solution container and a dispensing position wherein the bubble solution flows out of the bubble solution container and into the bubble solution dispenser;

wherein altering the support member from the non-dispensing position to the dispensing position while the support member supports the bubble solution container actuates a switch to power the motor; and wherein the support member is pivotably coupled to the bubble solution dispenser so that altering the support member between the non-dispensing and dispensing positions comprises pivoting the support member about an axis that is perpendicular to and non-coplanar with the longitudinal axis of the housing, and wherein the support member is coupled to the bubble solution dispenser in both the non-dispensing and dispensing positions.

2. The apparatus according to claim 1 further comprising an actuation assembly comprising:

the switch; and an actuation member located on the support member; and wherein when the support member is in the dispensing position and is supporting the bubble solution container, the actuation member contacts the switch and alters the switch into a closed state to power the motor.

3. The apparatus according to claim 1 wherein altering the support member from the dispensing position to the non-dispensing position alters the switch into an open state so that the motor is not powered.

4. The apparatus according to claim 1 wherein the support member comprises a sidewall having an inner surface and an outer surface, a ledge extending from the inner surface to support the bubble solution container, and an actuation member for actuating the switch.

5. The apparatus according to claim 1 wherein the bubble generating assembly comprises a plurality of the bubble generating devices and is operably coupled to the motor so that upon actuating the switch to power the motor the bubble generating assembly rotates about a rotational axis, and wherein upon rotating the bubble generating assembly about the rotational axis each of the plurality of bubble generating devices becomes aligned with the at least one delivery member of the bubble solution dispenser to become loaded with the bubble solution and then aligned with the air stream generated by the fan device to generate bubbles from the bubble solution loaded on the bubble generating devices.

6. The apparatus according to claim 1 further comprising a drip tray that is detachably coupled to the housing, the drip tray comprising a collection reservoir for collecting excess amounts of the bubble solution that is dispensed from the bubble solution dispenser and not loaded onto the at least one bubble generating device of the bubble generating assembly.

7. The apparatus according to claim 6 wherein the drip tray comprises a floor, an outer wall, and a drainage member protruding from the floor and being spaced apart from the outer wall so that the collection reservoir is defined by the floor, an inner surface of the outer wall, and an outer surface of the drainage member, the drainage member comprising a distal surface and a plurality of second connection members extending from the distal surface in a spaced apart manner, and wherein a lower portion of the housing comprises a plurality of first connection members arranged in a spaced apart manner that interact with the plurality of second connection members to detachably couple the housing to the drip tray, and further comprising a plurality of air inlet openings defined between adjacent ones of the first and second connection members when the drip tray is coupled to the housing, each of the air inlet openings being a closed-geometry aperture, and each of the air inlet openings being bounded by an edge of two adjacent ones of the first connection members and an edge of two adjacent ones of the second connection members.

8. The apparatus according to claim 1 wherein the housing comprises an outer annular wall that forms an exposed outer surface of the housing and a first inner annular wall that is radially spaced apart from the outer annular wall so that an excess fluid passageway is defined between the outer annular wall and the first inner annular wall, and wherein excess amounts of the bubble solution that is dispensed from the bubble solution dispenser without becoming loaded onto the at least one bubble generating device flows through the excess fluid passageway and into a collection trough, wherein a cross-sectional area of the excess fluid passageway increases moving in a direction from the collection trough to a distal end of the housing.

9. The apparatus according to claim 8 wherein the outer annular wall and the first inner annular wall of the housing are connected to form a floor of the excess fluid passageway, and further comprising at least one opening in the floor of the excess fluid passageway to allow the excess amounts of the bubble solution to flow through the floor of the excess fluid passageway and into the collection trough.

10. The apparatus according to claim 8 wherein the housing comprises a second inner annular wall radially spaced apart from the first inner annular wall to define an air flow passageway between the first and second inner annular walls through which the air stream generated by the fan device flows, the air flow passageway positioned radially inward of the excess fluid passageway, and wherein the motor rotates the bubble generating assembly about a rotational axis thereby moving the at least one bubble generating device along the air flow passageway.

11. The apparatus according to claim 10 further comprising at least one funneling reservoir defined between the first and second inner annular walls, the at least one funneling reservoir receiving a portion of the excess amounts of the bubble solution and funneling the excess amounts of the bubble solution into the excess fluid passageway, wherein the at least one funneling reservoir is defined by a floor, a portion of the first inner annular wall, a portion of the second inner annular wall, and first and second upstanding walls extending upwardly from the floor and extending between the first inner annular wall and the second inner annular wall in a circumferentially spaced apart manner, and further comprising an aperture in the portion of the first inner annular wall providing a passageway for the excess amounts of the bubble solution to flow from the at least one funneling reservoir to the excess fluid passageway.

12. An apparatus for generating bubbles comprising:

a housing extending along a longitudinal axis;

a motor positioned in the housing;

a fan device operably coupled to the motor to generate an air stream;

a bubble generating assembly comprising at least one bubble generating device that is aligned with the air stream generated by the fan device;

a bubble solution dispenser comprising at least one delivery member for delivering bubble solution to the at least one bubble generating device;

a support member configured to support a bubble solution container containing a bubble solution, the support member alterable between a non-dispensing position wherein the bubble solution does not flow out of the bubble solution container and a dispensing position wherein the bubble solution flows out of the bubble solution container and into the bubble solution dispenser;

wherein altering the support member from the non-dispensing position to the dispensing position while the support member supports the bubble solution container actuates a switch to power the motor;

wherein the support member comprises a sidewall having an inner surface and an outer surface, a ledge extending from the inner surface to support the bubble solution container, and an actuation member for actuating the switch; and wherein the actuation member comprises a flexible tab having a first tab portion that extends from the inner surface of the sidewall and a second tab portion, and wherein when the support member is supporting the bubble solution container, the bubble solution container contacts the first tab portion of the flexible tab and moves the second tab portion of the flexible tab radially outward in a direction away from the outer surface of the sidewall so that the second tab portion of the flexible tab will actuate the switch when the support member is altered into the dispensing position.

13. An apparatus for generating bubbles comprising:

a power source;

a motor;

a switch alterable between an open state in which the power source is not operably coupled to the motor and a closed state in which the power source is operably coupled to the motor to cause the motor to rotate about a rotational axis;

a fan device operably coupled to the motor so that the fan device generates an air stream when the switch is in the closed state;

a bubble generating assembly comprising at least one bubble generating device that is aligned with the air stream generated by the fan device;

a bubble solution dispenser comprising at least one delivery member for loading a bubble solution onto the at least one bubble generating device;

a support member supporting a container of bubble solution, the support member alterable between a non-dispensing position in which the container is prevented from dispensing the bubble solution into the bubble solution dispenser and a dispensing position in which the container dispenses the bubble solution into the bubble solution dispenser;

wherein when the support member is in the dispensing position the switch is actuated into the closed state; and wherein the bubble solution dispenser comprises a main body portion comprising a holding reservoir defined by a floor and a sidewall and the at least one delivery member extending from the main body portion, the at least one delivery member comprising a delivery reservoir fluidly coupled to the holding reservoir, the at least one delivery member comprising a floor having a slit through which the bubble solution can fall by gravity onto the bubble generating device to load the bubble generating device with the bubble solution, wherein the switch is located along the sidewall of the reservoir of the bubble solution dispenser, and wherein when the support member is in the dispensing position at least a portion of the support member is located in the holding reservoir of the bubble solution dispenser while an actuation member of the support member engages the switch to alter the switch into the closed state.

14. The apparatus according to claim 13 wherein the switch is biased into the open state, and wherein the actuation member of the support member engages the switch to alter the switch into the closed state when the support member is in the dispensing position.

15. The apparatus according to claim 14 wherein the actuation member only alters the switch into the closed state when the support member is in the dispensing position and the support member is supporting the container of bubble solution.

16. The apparatus according to claim 13 wherein when the support member is in the non-dispensing position the switch is in the open state unless manually actuated by a user.

17. The apparatus according to claim 13 wherein the bubble generating assembly is operably coupled to the motor so that the bubble generating assembly rotates about the rotational axis when the switch is in the closed state.

18. An apparatus for generating bubbles comprising:

a housing extending along a longitudinal axis, the housing comprising:

an outer annular wall formed an exposed outer surface of the housing;

a first inner annular wall spaced radially inward of the outer annular wall so that an excess fluid passageway is defined between the outer annular wall and the first inner annular wall, the first inner annular wall connected to the outer annular wall to form a floor of the excess fluid passageway, the floor having at least one opening; and a second inner annular wall spaced radially inward of the first inner annular wall so that an air flow passageway is defined between the first and second inner annular walls;

a motor positioned in the housing;

a fan device operably coupled to the motor to generate an air stream that flows through the air flow passageway;

a bubble generating assembly comprising at least one bubble generating device that is aligned with the air stream generated by the fan device;

a bubble solution dispenser comprising at least one delivery member for loading a bubble solution onto the at least one bubble generating device; and wherein excess amounts of the bubble solution that are dispensed from the bubble solution dispenser without being loaded onto the at least one bubble generating device flows into the excess fluid passageway, through the at least one opening in the floor of the excess fluid passageway, and into a collection trough.

* * * * *